US008781348B2

(12) United States Patent
Ogino et al.

(10) Patent No.: US 8,781,348 B2
(45) Date of Patent: Jul. 15, 2014

(54) TRANSFER DEVICE AND IMAGE FORMING APPARATUS INCORPORATING SAME

(75) Inventors: Yasuhiko Ogino, Kanagawa (JP); Haruo Iimura, Kanagawa (JP); Shinji Aoki, Kanagawa (JP); Keigo Nakamura, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 413 days.

(21) Appl. No.: 13/206,957

(22) Filed: Aug. 10, 2011

(65) Prior Publication Data

US 2012/0045231 A1 Feb. 23, 2012

(30) Foreign Application Priority Data

Aug. 20, 2010 (JP) ..... 2010-185454

(51) Int. Cl.
*G03G 15/16* (2006.01)

(52) U.S. Cl.
USPC ..... 399/45; 399/66

(58) Field of Classification Search
CPC ..... G03G 15/14
USPC ..... 399/45, 66, 310, 314
See application file for complete search history.

(56) References Cited

U.S. PATENT DOCUMENTS

| | | | | |
|---|---|---|---|---|
| 5,595,852 | A | 1/1997 | Shimoda et al. | |
| 6,284,424 | B1 | 9/2001 | Iimura et al. | |
| 7,251,442 | B2 * | 7/2007 | Sato et al. | 399/296 |
| 7,662,530 | B2 | 2/2010 | Iimura | |
| 2006/0110192 | A1 * | 5/2006 | Shin | 399/314 |
| 2007/0178398 | A1 | 8/2007 | Ogino et al. | |
| 2008/0187857 | A1 | 8/2008 | Ogino et al. | |
| 2009/0123168 | A1 | 5/2009 | Aoki et al. | |
| 2009/0142087 | A1 | 6/2009 | Iimura | |
| 2010/0098446 | A1 | 4/2010 | Ishikawa et al. | |
| 2010/0226697 | A1 | 9/2010 | Ogino | |
| 2010/0232820 | A1 | 9/2010 | Usami et al. | |

(Continued)

FOREIGN PATENT DOCUMENTS

| | | |
|---|---|---|
| JP | 4-86878 | 3/1992 |
| JP | 9-146381 | 6/1997 |

(Continued)

OTHER PUBLICATIONS

U.S. Appl. No. 13/208,673, filed Aug. 12, 2011, Nakamura, et al.

(Continued)

*Primary Examiner* — David Gray
*Assistant Examiner* — Michael Harrison
(74) *Attorney, Agent, or Firm* — Oblon, Spivak, McClelland, Maier & Neustadt, L.L.P.

(57) ABSTRACT

A transfer device includes a controller that controls a transfer bias supply to cause a transfer bias to increase, between an image carrier and a first rotary body disposed opposite the image carrier, a potential of the first rotary body toward an opposite polarity to a charge polarity of toner of a toner image on the image carrier to be higher than a potential of the image carrier, and to change, on the basis of identified recording medium type, a returning peak value which is one of a peak value of positive polarity and a peak value of negative polarity of the transfer bias and which generates an electric field that causes the toner having moved to the recording medium from the image carrier to return to the image carrier from the recording medium in a transfer nip.

20 Claims, 12 Drawing Sheets

(56) References Cited

U.S. PATENT DOCUMENTS

| | | | | |
|---|---|---|---|---|
| 2010/0284705 | A1 | 11/2010 | Aoki et al. | |
| 2010/0329707 | A1* | 12/2010 | Yamada | 399/44 |
| 2011/0058831 | A1 | 3/2011 | Usami et al. | |
| 2012/0237234 | A1* | 9/2012 | Sugimoto et al. | 399/50 |
| 2013/0142531 | A1* | 6/2013 | Sugimoto et al. | 399/66 |
| 2013/0148993 | A1* | 6/2013 | Aoki et al. | 399/66 |

FOREIGN PATENT DOCUMENTS

| | | |
|---|---|---|
| JP | 2002-307737 | 10/2002 |
| JP | 2004-246341 | 9/2004 |
| JP | 2006-259303 | 9/2006 |
| JP | 2006-267486 | 10/2006 |
| JP | 2008-58585 | 3/2008 |
| JP | 2008-185890 | 8/2008 |

OTHER PUBLICATIONS

U.S. Appl. No. 12/929,606, filed Feb. 3, 2011.

U.S. Appl. No. 13/042,635, filed Mar. 8, 2011, Emiko Shiraishi, et al.

U.S. Appl. No. 13/064,750, filed Apr. 13, 2011.

* cited by examiner

DC VOLTAGE ONLY

DC VOLTAGE + AC VOLTAGE

Voff=2.0 kV, Vpp=0 kV

Voff=2.0 kV, Vpp=4.0 kV

Voff=2.0 kV, Vpp=8.0 kV

TRANSFER DEVICE AND IMAGE FORMING APPARATUS INCORPORATING SAME

CROSS-REFERENCE TO RELATED APPLICATIONS

This patent application is based on and claims priority pursuant to 35 U.S.C. §119 to Japanese Patent Application No. 2010-185454, filed on Aug. 20, 2010, in the Japan Patent Office, the entire disclosure of which is hereby incorporated herein by reference.

FIELD OF THE INVENTION

The present invention relates to a transfer device for transferring a toner image carried on an image carrier onto a recording medium, and an image forming apparatus including the transfer device.

BACKGROUND OF THE INVENTION

There is known a background image forming apparatus which forms a toner image on a surface of a drum-shaped photoconductor through a well-known electrophotographic process.

The structural configuration of such an apparatus is as follows. An endless intermediate transfer belt is brought into contact with the photoconductor to form a primary transfer nip. In the primary transfer nip, the toner image on the photoconductor is primarily transferred onto the intermediate transfer belt. A secondary transfer roller is brought into contact with the intermediate transfer belt to form a secondary transfer nip. In the loop of the intermediate transfer belt, a secondary transfer opposite roller is disposed. The intermediate transfer belt is nipped between the secondary transfer opposite roller and the above-described secondary transfer roller. The secondary transfer opposite roller disposed inside the loop is electrically grounded. By contrast, a secondary transfer bias is applied to the secondary transfer roller disposed outside the loop. Between the secondary transfer opposite roller and the secondary transfer roller, therefore, a secondary transfer electric field is generated which electrostatically moves the toner image from the side of the secondary transfer opposite roller toward the side of the secondary transfer roller. The toner image on the intermediate transfer belt is secondarily transferred onto a recording sheet conveyed into the secondary transfer nip in synchronization with the toner image on the intermediate transfer belt.

In the above-described configuration, with recording media with substantial surface roughness, such as a Japanese paper sheet, an uneven toner image density pattern conforming to the surface roughness tends to be formed in the toner image, owing to a failure to transfer a sufficient amount of toner to recesses in a surface of the sheet.

Accordingly, the background image forming apparatus employs, as the secondary transfer bias, a superimposed bias including an alternating current (AC) voltage component superimposed on a direct current (DC) voltage component, instead of a bias including only a DC voltage. It has been shown experimentally that it is possible to minimize the formation of an uneven density pattern conforming to the surface roughness of the recording sheet by employing the secondary transfer bias including a superimposed bias.

However, the present inventors have found from experiments that, depending on the voltage condition of the secondary transfer bias, the formation of an uneven density pattern is either insufficiently minimized or, if minimized, white spots attributed to uncontrolled electrical discharge appear in the image.

The above issues are described in further detail below with reference to the configurations shown in FIGS. 1 and 2. FIG. 1 is an enlarged configuration diagram of a related-art image forming apparatus 530 illustrating an example of the secondary transfer nip. As shown in FIG. 1, an intermediate transfer belt 531 is pressed against a nip formation roller 536 by a transfer inner surface roller 533 in contact with an inner surface of the intermediate transfer belt 531. With this pressing, a transfer nip is formed in which an outer surface of the intermediate transfer belt 531 and the nip formation roller 536 come into contact with each other. A toner image on the intermediate transfer belt 531 is transferred onto a recording sheet P conveyed into the transfer nip. A transfer bias for generating a transfer electric field for transferring the toner image is applied to one of the two rollers illustrated in the drawing, and the other roller is electrically grounded. It is possible to transfer the toner image onto the recording sheet P, irrespective of which one of the rollers is supplied with the transfer bias. Herein, a description is given of a case of applying the transfer bias to the transfer inner surface roller 533 and using toner of negative polarity. In this case, to move the toner in the transfer nip from the side of the transfer inner surface roller 533 toward the side of the nip formation roller 536, a bias having a time-averaged electric potential of the same negative polarity as the polarity of the toner is applied as the transfer bias including a superimposed bias. In a case in which toner of negative polarity is used and a transfer bias is applied to the nip formation roller 536, it is necessary to employ a transfer bias having a time-averaged potential of positive polarity, that is, a polarity that is the opposite of the polarity of the toner.

FIG. 2 is a waveform chart illustrating an example of a waveform of the transfer bias including a superimposed bias and applied to the transfer inner surface roller 533. In the drawing, an offset voltage Voff in volts (V) represents the time-averaged value of the potential difference between the transfer inner surface roller 533 and the nip formation roller 536. In the illustrated example, the nip formation roller 536 is electrically grounded. Therefore, the value of the offset voltage Voff is substantially equal to the value of the DC component of the transfer bias. As illustrated in the drawing, the superimposed bias has a sinusoidal waveform, and includes a positive peak value and a negative peak value. A reference sign Vt represents one of the two peak values for moving the toner in the transfer nip from the intermediate transfer belt side toward the recording sheet side, i.e., the negative peak value in the present example (hereinafter referred to as the transferring peak value Vt). A reference sign Vr represents the other peak value for returning the toner from the recording sheet side toward the intermediate transfer belt side, i.e., the positive peak value in the present example (hereinafter referred to as the returning peak value Vr). Vpp represents the peak-to-peak voltage.

Even if an AC bias including only an AC component is applied instead of the superimposed bias as illustrated in the drawing, it is possible to move the toner back and forth between the intermediate transfer belt 531 and the recording sheet P in the transfer nip. The AC bias, however, simply moves the toner back and forth, and is unable to transfer the toner onto the recording sheet P. If a superimposed bias including a DC component is applied to adjust the offset voltage Voff, i.e., the time-averaged value of the potential difference between the two rollers, to the same negative polarity as the polarity of the toner, it is possible to transfer the toner from the intermediate transfer belt side toward the recording sheet side during the back-and-forth movement thereof, and thereby to transfer the toner onto the recording sheet P.

The present inventors have observed the behavior of the toner in the transfer nip supplied with a superimposed bias including a DC component and an AC component as the transfer bias and found that, when the superimposed bias starts to be applied, only a very small number of toner particles present on a surface of a toner layer on the intermediate transfer belt 531 first separates from the toner layer and moves toward recesses of the recording sheet P. Most of the toner particles present in the toner layer remain therein. The very small number of toner particles having separated from the toner layer enters the recesses of the recording sheet P. Thereafter, if the direction of the electric field is reversed, the toner particles return from the recesses to the toner layer. In this process, the returning toner particles collide with other toner particles remaining in the toner layer, and reduce the adhesion of the other toner particles. Then, in the next reversal of the direction of the electric field to the direction for moving toner particles toward the recording sheet P, a larger number of toner particles than in the first cycle separates from the toner layer and moves toward the recesses of the recording sheet P. As the above-described sequence is repeated, the number of toner particles separating from the toner layer and entering the recesses of the recording sheet P is gradually increased. Consequently, a sufficient number of toner particles is eventually transferred to the recesses.

However, it was found that, if the absolute value of the returning peak value Vr illustrated in FIG. 2 is relatively small, it is difficult to cause the toner particles transferred into the recesses of the recording sheet P to return to the toner layer, and the toner particles remain in the recesses. This results in a failure to increase the number of subsequent toner particles and a deficiency in overall toner adhesion amount in the recesses. It was also found that the lower limit value of the returning peak value Vr required to transfer a sufficient amount of toner into the recesses varies depending on the depth of the recesses because the reverse electric field for causing the toner particles having entered the recesses to return to the toner layer needs to be increased in intensity in accordance with an increase in depth of the recesses. Therefore, the above-described lower limit value is increased. That is, the deeper the recesses of the recording sheet P, the larger the lower limit value of the returning peak value Vr required to transfer a sufficient amount of toner into the recesses. Therefore, to transfer a sufficient amount of toner into the recesses of the recording sheet P, if the recesses are very deep, the returning peak value Vr needs to be set to a very large value. As observed from the waveform of FIG. 2, however, the peak-to-peak voltage Vpp also needs to be increased to set the returning peak value Vr to a relatively large value. If the peak-to-peak voltage Vpp is increased, however, white spots attributed to uncontrolled electrical discharge tend to appear in the image. The white spots are attributed to discharge occurring across a gap between a bottom portion of the recesses of the recording sheet P and an image carrier, such as the intermediate transfer belt 531. Moreover, the higher the peak-to-peak voltage Vpp, the more easily discharge occurs. Further, the shallower the recesses, the more easily discharge occurs, provided that the peak-to-peak voltage Vpp is the same. Therefore, if the returning peak value Vr is set to a very large value to fully transfer the toner to a recording sheet with relatively deep recesses, the white spots attributed to discharge tend to appear in a recording sheet with relatively shallow recesses. At the same time, however, if the returning peak value Vr is reduced to minimize the appearance of white spots, it is difficult to transfer a sufficient amount of toner into the recesses of the recording sheet, if the recesses are relatively deep. As a result, an uneven density pattern is formed.

BRIEF SUMMARY OF THE INVENTION

The present invention describes a novel transfer device that includes an image carrier, a first rotary body, a second rotary body, a transfer bias supply, and a controller. The image carrier is movable in a predetermined moving direction to carry a toner image. The first rotary body contacts an outer surface of the image carrier. The second rotary body is pressed against an inner surface of the image carrier to form a transfer nip between the outer surface of the image carrier and the first rotary body. The transfer bias supply is operatively connected to the second rotary body to supply a transfer bias including a superimposed bias that includes a direct current component and an alternating current component superimposed on the direct current component for application to the image carrier to transfer the toner image from the image carrier onto a recording medium conveyed through the transfer nip. The controller is operatively connected to the transfer bias supply to control the transfer bias supply to cause the transfer bias to increase, between the image carrier and the first rotary body, an electric potential of the first rotary body toward an opposite polarity to a charge polarity of toner of the toner image to be higher than an electric potential of the image carrier, and to change, on the basis of identified recording medium type, a returning peak value which is one of a peak value of positive polarity and a peak value of negative polarity of the transfer bias and which generates an electric field that causes the toner having moved to the recording medium from the image carrier to return to the image carrier from the recording medium in the transfer nip.

The present invention further describes a novel transfer device that includes an image carrier, a first rotary body, a second rotary body, a transfer bias supply, and a controller. The image carrier is movable in a predetermined moving direction to carry a toner image. The first rotary body contacts an outer surface of the image carrier. The second rotary body is pressed against an inner surface of the image carrier to form a transfer nip between the outer surface of the image carrier and the first rotary body. The transfer bias supply is operatively connected to the first rotary body and the second rotary body to supply a transfer bias for application to the image carrier to transfer the toner image from the image carrier onto a recording medium conveyed through the transfer nip. The transfer bias supply includes a first power supply to generate the transfer bias including a superimposed bias that includes a direct current component and an alternating current component superimposed on the direct current component for supply to one of the first rotary body and the second rotary body and a second power supply to generate the transfer bias including only the direct current component for supply to the other one of the first rotary body and the second rotary body. The controller is operatively connected to the transfer bias supply to control the transfer bias supply to cause the transfer bias to increase, between the image carrier and the first rotary body, an electric potential of the first rotary body toward an opposite polarity to a charge polarity of toner of the toner image to be higher than an electric potential of the image carrier, and to change, on the basis of identified recording medium type, a returning peak value which is one of a peak value of positive polarity and a peak value of negative polarity of the transfer bias and which generates an electric field that causes the toner having moved to the recording medium from the image carrier to return to the image carrier from the recording medium in the transfer nip.

The present invention further describes a novel transfer device that includes an intermediate transferor, a first rotary body, a second rotary body, a transfer bias supply, and a controller. The intermediate transferor contacts a latent image carrier carrying a latent image to be developed into a toner image to form a primary transfer nip therebetween and carries the toner image transferred from the latent image carrier. The first rotary body contacts an outer surface of the intermediate transferor. The second rotary body is pressed against an inner surface of the intermediate transferor to form a secondary transfer nip between the outer surface of the intermediate transferor and the first rotary body. The transfer bias supply is operatively connected to one of the first rotary body and the second rotary body to supply a transfer bias including a superimposed bias that includes a direct current component and an alternating current component superimposed on the direct current component for application to the intermediate transferor to transfer the toner image from the intermediate transferor onto a recording medium conveyed through the secondary transfer nip. The controller is operatively connected to the transfer bias supply to control the transfer bias supply to cause the transfer bias to increase, between the intermediate transferor and the first rotary body, an electric potential of the first rotary body toward an opposite polarity to a charge polarity of toner of the toner image to be higher than an electric potential of the intermediate transferor, and to change, on the basis of identified recording medium type, a returning peak value which is one of a peak value of positive polarity and a peak value of negative polarity of the transfer bias and which generates an electric field that causes the toner having moved to the recording medium from the intermediate transferor to return to the intermediate transferor from the recording medium in the transfer nip.

The present invention further describes a novel image forming apparatus including any one of the transfer devices described above.

BRIEF DESCRIPTION OF THE SEVERAL VIEWS OF THE DRAWINGS

A more complete appreciation of the invention and many of the advantages thereof are obtained as the same becomes better understood by reference to the following detailed description when considered in connection with the accompanying drawings, wherein.

DETAILED DESCRIPTION OF THE INVENTION

Figure 1:
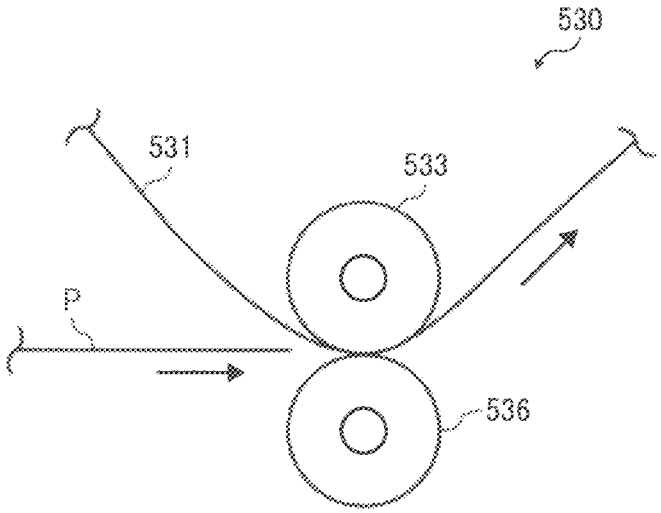
FIG. 1 RELATED ART
FIG. 1 is an enlarged configuration diagram of a related art image forming apparatus.

In describing the embodiments illustrated in the drawings, specific terminology is adopted for the purpose of clarity. However, the disclosure of the present invention is not intended to be limited to the specific terminology so used, and it is to be understood that substitutions for each specific element can include any technical equivalents that operate in a similar manner.

Referring now to the drawings, wherein like reference numerals designate identical or corresponding parts throughout the several views, a first embodiment of an electrophotographic color printer 301 (hereinafter simply referred to as the printer 301) will be described as an image forming apparatus according to an embodiment of the present invention.

Figure 3:
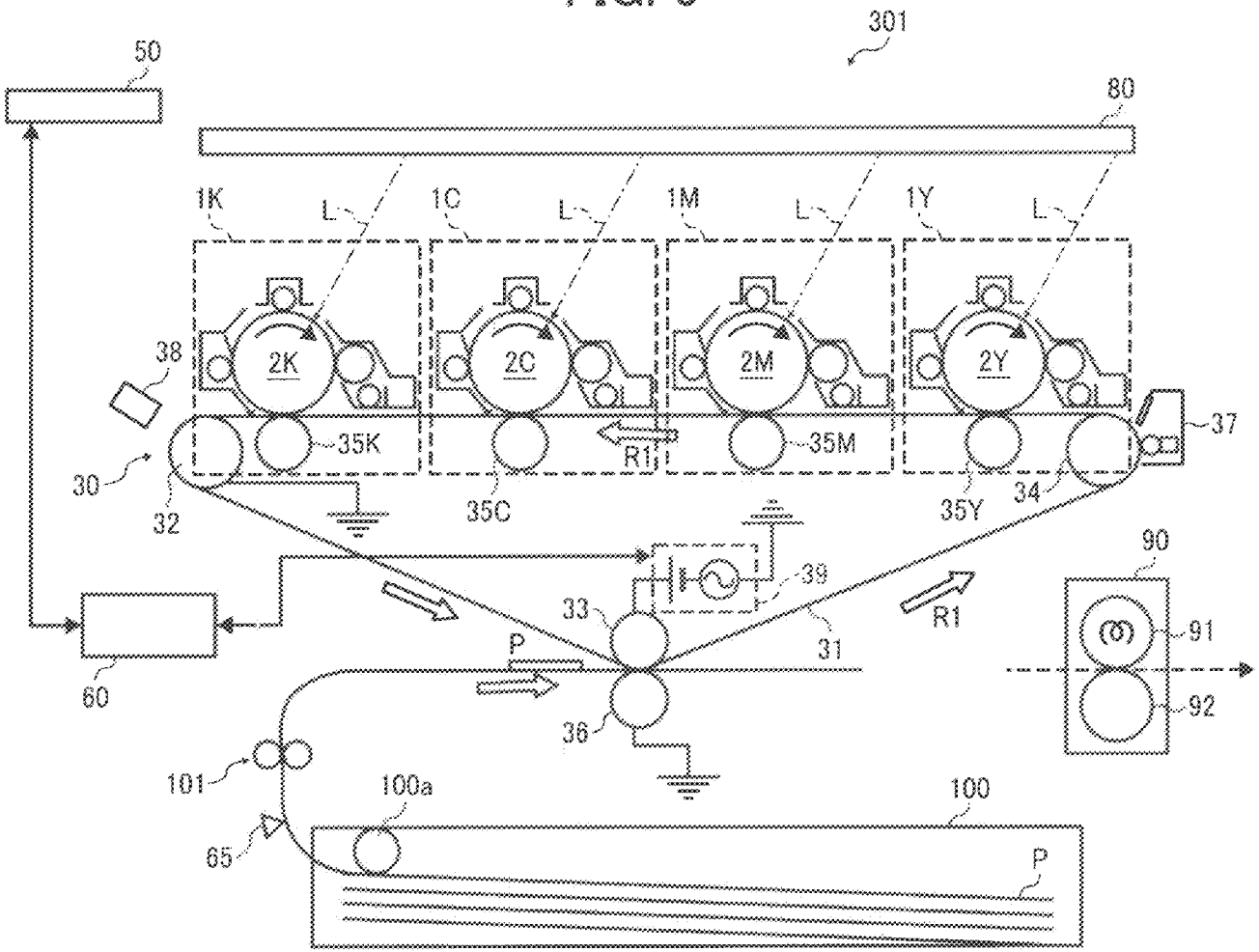
FIG. 3 is a schematic configuration diagram illustrating a printer according to a first embodiment.

A basic configuration of the printer 301 according to the first embodiment will be first described. FIG. 3 is a schematic configuration diagram illustrating the printer 301 according to the first embodiment. In the drawing, the printer 301 according to the first embodiment includes four image forming units 1Y, 1M, 1C, and 1K for forming toner images of yellow, magenta, cyan, and black (hereinafter referred to as Y, M, C, and K, respectively) colors, a transfer unit 30 serving as a transfer device, an optical writer 80, a fixing device 90, a paper tray 100, a registration roller pair 101, a control panel 50, a controller 60, and so forth.

Figure 4:
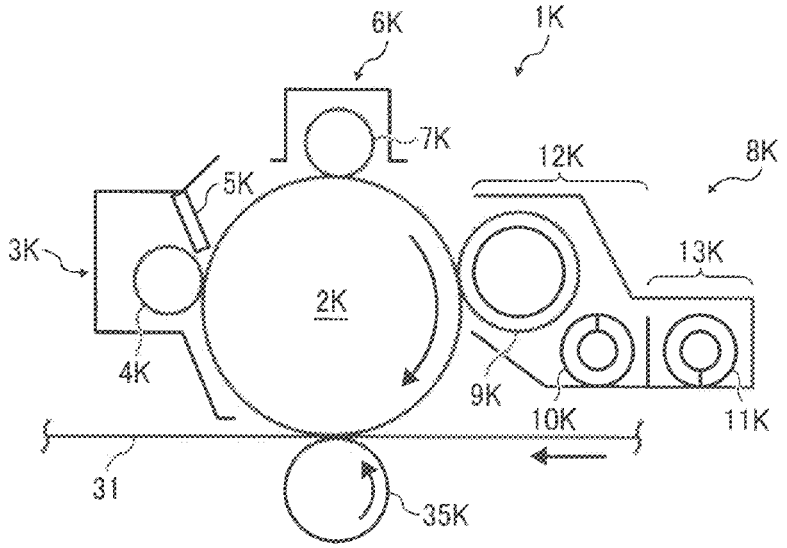
FIG. 4 is an enlarged vertical sectional view of an image forming unit for forming an image of black color provided in the printer shown in FIG. 3.

The four image forming units 1Y, 1M, 1C, and 1K use, as image forming material, Y, M, C, and K toners, respectively, which are different in color from one another. Except for the difference in color, the image forming units 1Y, 1M, 1C, and 1K are similar in configuration, and are replaced by new image forming units when the life thereof expires. For example, as shown in FIG. 4 illustrating a vertical sectional view of the image forming unit 1K, the image forming unit 1K for forming a K toner image includes a drum-shaped photoconductor 2K serving as a latent image carrier, a photoconductor cleaner 3K, a discharger, a charger 6K, a development device 8K, and so forth. The above-described components are held in a common holder to be detachably attached to a body of the printer 301 as a unit. It is thereby possible to replace the components at the same time.

The photoconductor 2K having an outer diameter of approximately 60 mm is constructed of a drum-shaped base having an outer circumferential surface provided with an organic photosensitive layer, and is driven to rotate clockwise in the drawing by a driver. In the charger 6K, a charging roller 7K applied with a charging bias is brought into contact with or proximity to the photoconductor 2K to cause discharge between the charging roller 7K and the photoconductor 2K. Thereby, an outer circumferential surface of the photoconductor 2K is uniformly charged. In the printer 301, the surface of the photoconductor 2K is uniformly charged to the same negative polarity as a normal charge polarity of toner. As the charging bias, a DC voltage superimposed on an AC voltage is employed. The charging roller 7K is constructed of a metal core having an outer circumferential surface covered by a conductive elastic layer made of a conductive elastic material. The method of bringing a charging member, such as the charging roller 7K, into contact with or proximity to the photoconductor 2K may be replaced by a method using a charger.

The uniformly charged surface of the photoconductor 2K is subjected to optical scanning with laser light L emitted from the later-described optical writer 80 illustrated in FIG. 3, and carries an electrostatic latent image for the K color. The electrostatic latent image for the K color is developed into a K toner image by the development device 8K using K toner. Then, the K toner image is primarily transferred onto a later-described intermediate transfer belt 31 of the transfer unit 30.

The photoconductor cleaner 3K removes post-transfer residual toner adhering to the surface of the photoconductor 2K after a primary transfer process, i.e., after the passage through a later-described primary transfer nip. The photoconductor cleaner 3K includes a cleaning brush roller 4K driven to rotate, and a cantilever-supported cleaning blade 5K having a free end brought into contact with the photoconductor 2K. The rotating cleaning brush roller 4K scrapes the post-transfer residual toner from the surface of the photoconductor 2K. Further, the cleaning blade 5K scrapes the post-transfer residual toner off the surface of the photoconductor 2K. The cleaning blade 5K is brought into contact with the photoconductor 2K in a counter direction in which the cantilever-supported end of the cleaning blade 5K is directed further downstream in the photoconductor rotation direction than the free end of the cleaning blade 5K.

The above-described discharger discharges residual charge remaining on the photoconductor 2K after the cleaning by the photoconductor cleaner 3K. With the discharging, the surface of the photoconductor 2K is initialized to prepare for the next image forming operation.

The development device 8K includes a development section 12K housing a development roll 9K, and a developer conveying section 13K for stirring and conveying a K developer. The developer conveying section 13K includes a first conveying chamber housing a first screw 10K, and a second conveying chamber housing a second screw 11K. Each of the first screw 10K and the second screw 11K includes a rotary shaft having opposite end portions in an axial direction thereof rotatably supported by respective shaft bearings, and a helical blade helically protruding from an outer circumferential surface of the rotary shaft.

The first conveying chamber housing the first screw 10K and the second conveying chamber housing the second screw 11K are separated by a dividing wall. The dividing wall has opposite end portions in the axial direction of the first screw 10K and the second screw 11K formed with communication ports through which the two conveying chambers communicate with each other. The first screw 10K is driven to rotate to stir, in a rotation direction thereof, the K developer held inside the helical blade, and conveys the K developer from the far side toward the near side in a direction perpendicular to the plane of the drawing. The first screw 10K and the later-described development roll 9K are arranged parallel to each other to face each other. In this case, therefore, a conveyance direction of the K developer extends along an axial direction of the development roll 9K. The first screw 10K supplies the K developer to an outer circumferential surface of the development roll 9K along the axial direction of the development roll 9K.

The K developer conveyed to the proximity of an end portion of the first screw 10K on the near side in the drawing enters the second conveying chamber through the communication port provided near the end portion of the dividing wall on the near side in the drawing. Thereafter, the K developer is held inside the helical blade of the second screw 11K. Then, as the second screw 11K is driven to rotate, the K developer is stirred in a rotation direction of the second screw 11K and conveyed from the near side toward the far side in the drawing.

In the second conveying chamber, a K toner concentration detection sensor is mounted on a lower wall of a casing of the development device 8K to detect the K toner concentration in the K developer in the second conveying chamber. A magnetic permeability sensor is employed as the K toner concentration detection sensor. The magnetic permeability of the K developer containing the K toner and magnetic carrier is correlated with the K toner concentration. Therefore, the magnetic permeability sensor detects the K toner concentration.

The printer 301 includes Y, M, C, and K toner replenishers for separately replenishing the Y, M, C, and K toners into the respective second conveying chambers of the development devices for the Y, M, C, and K colors. Further, the later-described controller 60 of the printer 301 stores, in a RAM (Random Access Memory), a value Vtref for each of the Y, M, C, and K colors, which is the target value of the voltage output from each of the Y, M, C, and K toner concentration detection sensors. If the difference between the value of the voltage output from one of the Y, M, C, and K toner concentration detection sensors and the target value Vtref for the corresponding one of the Y, M, C, and K colors exceeds a predetermined value, the corresponding one of the Y, M, C, and K toner replenishers is driven for a length of time corresponding to that difference. Thereby, the second conveying chamber of the corresponding one of the development devices for the Y, M, C, and K colors is replenished with the corresponding one of the Y, M, C, and K toners.

The development roll 9K housed in the development section 12K is disposed opposite the first screw 10K, and is also disposed opposite the photoconductor 2K through an opening disposed in the casing. Further, the development roll 9K includes a cylindrical development sleeve constructed of a non-magnetic pipe and driven to rotate, and a magnet roller fixedly provided inside the development sleeve so as not to be rotated together with the development sleeve. With magnetic force generated by the magnet roller, the development roll 9K carries, on an outer circumferential surface of the development sleeve, the K developer supplied by the first screw 10K, and conveys the K developer to a development area disposed opposite the photoconductor 2K in accordance with the rotation of the development sleeve.

The development sleeve is applied with a development bias, which is the same in polarity as the K toner and has a potential higher than the potential of the electrostatic latent image on the photoconductor 2K and lower than the potential of the uniformly charged surface of the photoconductor 2K. Between the development sleeve and the electrostatic latent image on the photoconductor 2K, therefore, a development electric potential arises which electrostatically moves the K toner on the development sleeve toward the electrostatic latent image. Meanwhile, between the development sleeve and the background area on the photoconductor 2K, a non-development electric potential arises which moves the K toner on the development sleeve toward the surface of the development sleeve. With the action of the development potential and the non-development potential, the K toner on the development sleeve is selectively transferred to the electrostatic latent image on the photoconductor 2K to develop the electrostatic latent image into the K toner image.

In FIG. 3 described above, the Y, M, and C toner images are also formed on the photoconductors 2Y, 2M, and 2C in the image forming units 1Y, 1M, and 1C for the Y, M, and C colors, in a manner similarly to that of the image forming unit 1K for the K color.

Above the image forming units 1Y, 1M, 1C, and 1K, the optical writer 80 is provided which serves as a latent image writer. The optical writer 80 optically scans the photoconductors 2Y, 2M, 2C, and 2K with laser light L emitted from laser diodes on the basis of image data transmitted from an external device, such as a personal computer. With the optical scanning, electrostatic latent images for the Y, M, C, and K colors are formed on the photoconductors 2Y, 2M, 2C, and 2K. Specifically, in the entire area on the uniformly charged surface of each of the photoconductors 2Y, 2M, 2C, and 2K, a portion applied with the laser light L has an attenuated potential. Thereby, an electrostatic latent image is formed in the portion applied with the laser light L, in which the potential is lower than in the other area, i.e., the background area. The optical writer 80 applies the laser light L emitted from a light source to each of the photoconductors 2Y, 2M, 2C, and 2K via a plurality of optical lenses and mirrors, while polarizing the laser light L in a main scanning direction with the use of a polygon mirror driven to rotate by a polygon motor. The optical writer 80 may perform optical writing with LED (Light-Emitting Diode) light emitted from a plurality of LEDs of an LED array.

Under the image forming units 1Y, 1M, 1C, and 1K, the transfer unit 30 is provided which serves as a transfer device for stretching and rotating the endless intermediate transfer belt 31 counterclockwise in FIG. 3 in a belt moving direction R1. The transfer unit 30 includes, in addition to the intermediate transfer belt 31 serving as an image carrier, a drive roller 32, a secondary transfer inner surface roller 33, a cleaning backup roller 34, four primary transfer rollers 35Y, 35M, 35C, and 35K, a nip formation roller 36, a belt cleaner 37, a potential sensor 38, and so forth.

The intermediate transfer belt 31 is stretched over the drive roller 32, the secondary transfer inner surface roller 33, the cleaning backup roller 34, and the four primary transfer rollers 35Y, 35M, 35C, and 35K, which are disposed inside the loop of the intermediate transfer belt 31. With rotational force of the drive roller 32 driven to rotate counterclockwise in the drawing by a driver, the intermediate transfer belt 31 is rotated counterclockwise in the belt moving direction R1. The intermediate transfer belt 31 includes an endless belt having the following characteristics: a thickness in a range of from approximately 20 μm to approximately 200 μm, preferably approximately 60 μm, and a volume resistivity in a range of from approximately 1e6 Ωcm (ohm centimeters) to approximately 1e12 Ωcm, preferably approximately 1e9 Ωcm as measured by a Hiresta-UP MCP-HT450 resistivity meter manufactured by Mitsubishi Chemical Analytech Co., Ltd. with an applied voltage of approximately 100 V. Further, the intermediate transfer belt 31 is made of a carbon dispersed polyimide resin.

The rotating intermediate transfer belt 31 is nipped between the four primary transfer rollers 35Y, 35M, 35C, and 35K and the photoconductors 2Y, 2M, 2C, and 2K. Thereby, primary transfer nips for the Y, M, C, and K colors are formed in which an outer surface of the intermediate transfer belt 31 comes into contact with the photoconductors 2Y, 2M, 2C, and 2K. The primary transfer rollers 35Y, 35M, 35C, and 35K are applied with a primary transfer bias by primary transfer bias power supplies. Thereby, primary transfer electric fields are generated between the Y, M, C, and K toner images on the photoconductors 2Y, 2M, 2C, and 2K and the primary transfer rollers 35Y, 35M, 35C, and 35K. In accordance with the rotation of the photoconductor 2Y for the Y color, the Y toner image formed on the surface of the photoconductor 2Y enters the primary transfer nip for the Y color. Then, with the action of the primary transfer electric field and nip pressure, the Y toner image is primarily transferred from the photoconductor 2Y onto the intermediate transfer belt 31. Thereafter, the intermediate transfer belt 31 having the Y toner image thus primarily transferred thereto sequentially passes the respective primary transfer nips for the M, C, and K colors. Then, the M, C, and K toner images on the photoconductors 2M, 2C, and 2K are sequentially primarily transferred onto the Y toner image in a superimposed manner. With this primary transfer of the toner images in the superimposed manner, a four-color superimposed toner image is formed on the intermediate transfer belt 31.

Each of the primary transfer rollers 35Y, 35M, 35C, and 35K includes an elastic roller constructed of a metal core with a conductive sponge layer fixed on an outer circumferential surface thereof. Each of the primary transfer rollers 35Y, 35M, 35C, and 35K has the following characteristics: an outer diameter of approximately 16 mm, a core diameter of approximately 10 mm, and a sponge layer resistance R of approximately 3e7Ω, as calculated on the basis of Ohm's law (i.e., R=V/I) from a current I flowing by application of a voltage V of approximately 1,000 V to the primary transfer roller core with a grounded metal roller having an outer diameter of approximately 30 mm pressed against the sponge layer with force of approximately 10 N (Newtons). The thus-configured primary transfer rollers 35Y, 35M, 35C, and 35K are supplied with the primary transfer bias under constant current control. The primary transfer rollers 35Y, 35M, 35C, and 35K may be replaced by transfer chargers or transfer brushes.

The nip formation roller 36 of the transfer unit 30 is disposed outside the loop of the intermediate transfer belt 31. The intermediate transfer belt 31 is nipped between the nip formation roller 36, serving as a first rotary body, and the secondary transfer inner surface roller 33, serving as a second rotary body, disposed inside the loop of the intermediate transfer belt 31. Thereby, a secondary transfer nip is formed in which the outer surface of the intermediate transfer belt 31 and the nip formation roller 36 come into contact with each other. The nip formation roller 36 is grounded, and the secondary transfer inner surface roller 33 is supplied with a secondary transfer bias by a secondary transfer bias power supply 39 serving as a transfer bias supply. Between the secondary transfer inner surface roller 33 and the nip formation roller 36, therefore, a secondary transfer electric field is formed which electrostatically moves toner of negative polarity from the side of the secondary transfer inner surface roller 33 toward the side of the nip formation roller 36.

Below the transfer unit 30, the paper tray 100 is provided which stores a sheet bundle including a plurality of stacked recording sheets P. In the paper tray 100, the uppermost recording sheet P of the sheet bundle is made to come into contact with a sheet feeding roller 100*a*. The sheet feeding roller 100*a* is driven to rotate at a predetermined time to send the recording sheet P into a sheet feeding path. The registration roller pair 101 is provided near a lower end of the sheet feeding path. The registration roller pair 101 nips, between the two rollers thereof, the recording sheet P sent from the paper tray 100. Immediately thereafter, the rotation of the rollers is stopped. Then, the rollers are again driven to rotate at the time for causing the nipped recording sheet P to synchronize with the four-color superimposed toner image on the intermediate transfer belt 31 in the secondary transfer nip. Thereby, the recording sheet P is sent toward the secondary transfer nip. The toner images included in the four-color superimposed toner image on the intermediate transfer belt 31 brought into close contact with the recording sheet P in the secondary transfer nip are secondarily transferred onto the recording sheet P at the same time by the action of the secondary transfer electric field and nip pressure, and are formed into a full-color toner image with white color of the recording sheet P. The recording sheet P having the full-color toner image thus formed on a surface thereof passes the secondary transfer nip, and separates from the nip formation roller 36 and the intermediate transfer belt 31 owing to the curvatures of the nip formation roller 36 and the intermediate transfer belt 31.

The secondary transfer inner surface roller 33 has the following characteristics: an outer diameter of approximately 24 mm and a core diameter of approximately 16 mm. Further, the secondary transfer inner surface roller 33 includes a conductive NBR (Acrylonitrile-Butadiene Rubber)-based rubber layer covering an outer circumferential surface of a core. A resistance R of the rubber layer is in a range of from approximately 1e6Ω to approximately 1e12Ω, preferably approximately 4e7Ω. The value of the resistance R is measured by a method similar to the method used to measure the resistance R of the sponge layer in the primary transfer rollers 35Y, 35M, 35C, and 35K.

The nip formation roller 36 has the following characteristics: an outer diameter of approximately 24 mm and a core diameter of approximately 14 mm. Further, the nip formation roller 36 includes a conductive NBR-based rubber layer covering an outer circumferential surface of a core. A resistance R of the rubber layer is approximately 1e6Ω or less. The value of the resistance R is measured by a method similar to the method used to measure the resistance R of the sponge layer in the primary transfer rollers 35Y, 35M, 35C, and 35K.

The secondary transfer bias power supply 39 includes a DC power supply and an AC power supply, and is capable of outputting a DC voltage superimposed on an AC voltage as the secondary transfer bias. An output terminal of the secondary transfer bias power supply 39 is connected to the core of the secondary transfer inner surface roller 33. The value of the potential of the core of the secondary transfer inner surface roller 33 is substantially equal to the value of the voltage output from the secondary transfer bias power supply 39. Further, the core of the nip formation roller 36 is grounded, i.e., earth-connected. Alternatively, the configuration of applying the superimposed bias to the core of the secondary transfer inner surface roller 33 and grounding the core of the nip formation roller 36 may be replaced by a configuration of applying the superimposed bias to the core of the nip formation roller 36 and grounding the core of the secondary transfer inner surface roller 33. In this case, the polarity of the DC voltage is changed. Specifically, if the superimposed bias is applied to the secondary transfer inner surface roller 33 while using toner of negative polarity and grounding the nip formation roller 36, as illustrated in FIG. 3, a DC voltage of the same negative polarity as the polarity of the toner is used to set the time-averaged potential of the superimposed bias to the same negative polarity as the polarity of the toner. Meanwhile, if the secondary transfer inner surface roller 33 is grounded and the nip formation roller 36 is applied with the superimposed bias, a DC voltage of positive polarity opposite the polarity of the toner is used to set the time-averaged potential of the superimposed bias to positive polarity opposite the polarity of the toner. Further, the configuration of applying the superimposed bias to the secondary transfer inner surface roller 33 or the nip formation roller 36 may be replaced by a configuration of applying a DC voltage to one of the secondary transfer inner surface roller 33 and the nip formation roller 36 and applying an AC voltage to the other roller. The AC voltage employed in the present embodiment has a sinusoidal waveform. Alternatively, the AC voltage may have a rectangular waveform. Further, if the recording sheet P is not a sheet with relatively large surface roughness, such as a rough paper sheet, but a sheet with relatively small surface roughness, such as a plain paper sheet, an uneven density pattern conforming to the pattern of irregularities is not formed. In this case, therefore, a bias including only a DC voltage may be applied as the transfer bias. If a sheet with relatively large surface roughness, such as a rough paper sheet, is used, however, the transfer bias including only a DC voltage needs to be switched to a superimposed bias.

The intermediate transfer belt 31 having passed the secondary transfer nip has post-transfer residual toner adhering thereto, having failed to be transferred to the recording sheet P. The residual toner is cleaned off the surface of the intermediate transfer belt 31 by the belt cleaner 37 which comes into contact with the outer circumferential surface of the intermediate transfer belt 31. The cleaning backup roller 34 disposed inside the loop of the intermediate transfer belt 31 backs up, from inside the loop, the cleaning of the intermediate transfer belt 31 by the belt cleaner 37.

The potential sensor 38, serving as a potential detector, is disposed outside the loop of the intermediate transfer belt 31. In the entire area of the intermediate transfer belt 31 in a circumferential direction thereof, a portion of the intermediate transfer belt 31 passing over the grounded drive roller 32 is disposed opposite the potential sensor 38 via a gap of approximately 4 mm. When the toner image primarily transferred onto the intermediate transfer belt 31 enters the position disposed opposite the potential sensor 38, the potential sensor 38 measures the surface potential of the toner image. In the present embodiment, a surface potential sensor EFS-22D manufactured by TDK Corporation is used as the potential sensor 38.

The fixing device 90 (e.g., a fuser unit) is provided on the right side of the secondary transfer nip in FIG. 3. In the fixing device 90, a fixing nip is formed by a fixing roller 91 including a heat generation source, such as a halogen lamp, and a pressure roller 92 which rotates while in contact with the fixing roller 91 with predetermined pressure. The recording sheet P sent into the fixing device 90 is nipped in the fixing nip such that a surface of the recording sheet P carrying an unfixed toner image is brought into close contact with the fixing roller 91. Then, with heat and pressure applied to the recording sheet P, the toner in the toner image is softened, and the full-color image is fixed on the recording sheet P. The recording sheet P discharged from the fixing device 90 passes a post-fixation conveying path, and is discharged outside the printer 301.

To form a monochrome image, a support plate supporting the primary transfer rollers 35Y, 35M, and 35C for the Y, M, and C colors in the transfer unit 30 is moved to separate the primary transfer rollers 35Y, 35M, and 35C away from the photoconductors 2Y, 2M, and 2C, respectively. Thereby, the outer circumferential surface of the intermediate transfer belt 31 is separated from the photoconductors 2Y, 2M, and 2C, and the intermediate transfer belt 31 is brought into contact only with the photoconductor 2K for the K color. In this state, only the image forming unit 1K for the K color is driven among the four image forming units 1Y, 1M, 1C, and 1K. Thereby, the K toner image is formed on the photoconductor 2K.

Figure 2:
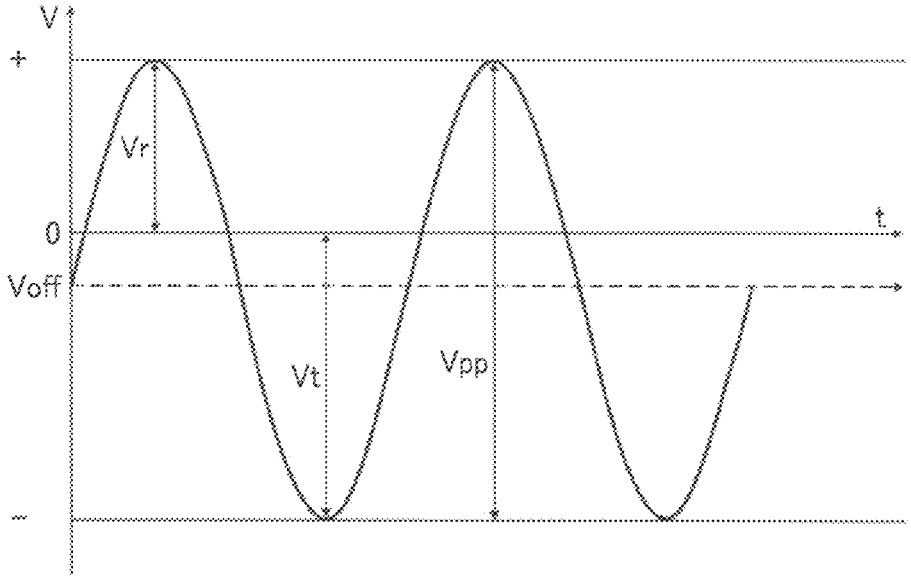
FIG. 2 RELATED ART
FIG. 2 is a waveform chart illustrating an example of a waveform of a transfer bias applied in the image forming apparatus shown in FIG. 1.

The secondary transfer bias power supply 39 outputs the secondary transfer bias including the superimposed bias illustrated in FIG. 2 described above. In the printer 301, the secondary transfer bias is applied to the core of the secondary transfer inner surface roller 33. The secondary transfer bias power supply 39 that outputs a voltage serves as a transfer bias supply that applies a transfer bias. If the secondary transfer bias is applied to the core of the secondary transfer inner surface roller 33, a potential difference is generated between the core of the secondary transfer inner surface roller 33 and the core of the nip formation roller 36. Therefore, the secondary transfer bias power supply 39 also functions as a potential difference generator. In general, the term "potential difference" refers to the absolute value of the potential difference. In the present specification, however, the term "potential difference" refers to the value of the potential difference with polarity. Specifically, the value obtained by subtraction of the potential of the core of the nip formation roller 36 from the potential of the core of the secondary transfer inner surface roller 33 will be referred to as the potential difference. In a configuration using toner of negative polarity, as in the printer 301, if the time-averaged value of the potential difference has negative polarity, the potential of the nip formation roller 36 is increased toward the opposite polarity to the charge polarity of the toner, i.e., toward positive polarity in the present example, to be higher than the potential of the secondary transfer inner surface roller 33. It is thereby possible to electrostatically move the toner from the side of the secondary transfer inner surface roller 33 toward the side of the nip formation roller 36.

In FIG. 2, the offset voltage Voff corresponds to the value of the DC component of the secondary transfer bias, and the peak-to-peak voltage Vpp corresponds to the peak-to-peak voltage of the AC component of the secondary transfer bias. As described above, in the printer 301, the secondary transfer bias corresponds to the offset voltage Voff and the peak-to-peak voltage Vpp superimposed on each other, and the time-averaged value of the secondary transfer bias is substantially equal to the value of the offset voltage Voff. Further, as described above, in the printer 301, the core of the secondary transfer inner surface roller 33 is applied with the secondary transfer bias, and the core of the nip formation roller 36 is grounded (i.e., 0 V). Therefore, the potential of the core of the secondary transfer inner surface roller 33 directly represents the potential difference between the two cores. The potential difference between the two cores is formed by the DC component substantially equal in value to the offset voltage Voff and the AC component substantially equal in value to the peak-to-peak voltage Vpp.

Subsequently, description is given of experiments conducted by the present inventors.

The present inventors prepared print test equipment similar in configuration to the printer 301 according to the first embodiment, and carried out a variety of print tests with the use of the print test equipment. In the print tests, a developer containing toner and magnetic carrier was used. The toner is a polyester-based toner produced by a pulverization method and including toner particles having an average particle diameter of approximately 6.8 μm. The magnetic carrier includes carrier particles having an average particle diameter of approximately 55.0 μm and each having a surface coated with a resin layer.

A first print test will now be described.

In the present print test, a voltage of approximately −0.8 kV was employed as an offset voltage Voff corresponding to the DC voltage of the secondary transfer bias including a superimposed bias. Further, a peak-to-peak voltage Vpp of approximately 2.5 kV was employed as the AC component. A frequency f in hertz (Hz) of the AC component and a process linear velocity v, i.e., the linear velocity of the photoconductors 2Y, 2M, 2C, and 2K or the intermediate transfer belt 31, were varied as appropriate. With the frequency f and the process linear velocity v set to different values, solid black images for test were output on a recording sheet P made of plain paper. Then, the quality of the output solid black images was visually evaluated on a two-point scale. The results of evaluation are presented in TABLE 1 given below. In the table, GOOD indicates that density irregularity, i.e., pitch irregularity, occurring in synchronization with the frequency f of the AC component was not visually observed, and POOR indicates that the pitch irregularity was visually observed.

TABLE 1

| Process linear velocity v | Frequency f (Hz) | | | | | | | | |
|---|---|---|---|---|---|---|---|---|---|
| (mm/s) | 50 | 100 | 200 | 300 | 400 | 500 | 600 | 700 | |
| 282 | POOR | POOR | POOR | POOR | GOOD | GOOD | GOOD | GOOD | Evaluation |
| 141 | POOR | POOR | GOOD | GOOD | GOOD | GOOD | GOOD | GOOD | |

As illustrated in TABLE 1, in the case of the process linear velocity v set to approximately 282 mm/s (millimeters per second), the occurrence of pitch irregularity was prevented with the frequency f of the AC component set to approximately 400 Hz or higher. Further, in the case of the process linear velocity v set to approximately 141 mm/s, the occurrence of pitch irregularity was prevented with the frequency f of the AC component set to approximately 200 Hz or higher. The lower limit value of the frequency f capable of preventing the occurrence of pitch irregularity varies depending on the process linear velocity v for the following reason. That is, the number of actions of the alternating electric field acting on the toner in the secondary transfer nip changes in accordance with the process linear velocity v. Specific description is given below.

When the secondary transfer nip is formed by direct contact of the intermediate transfer belt 31 and the nip formation roller 36 with the recording sheet P absent therebetween, the length of the secondary transfer nip in the belt moving direction R1 of the intermediate transfer belt 31 is defined as a nip length d (mm). In this case, a nip passage time (s) required for the passage through the secondary transfer nip is expressed as d/v where d represents the nip length and v represents the process linear velocity. Meanwhile, a cycle (s) of the AC component of the superimposed bias having the frequency f (Hz) is expressed as 1/f where f represents the frequency. During the nip passage time, therefore, a waveform corresponding to one cycle of the AC component is applied to the toner the d*f/v times. The nip length d is approximately 3 mm in the print test equipment. As illustrated in TABLE 1, when the process linear velocity v is approximately 282 mm/s, the lower limit value of the frequency f capable of preventing the occurrence of pitch irregularity is approximately 400 Hz. Therefore, the number of required waveforms is calculated as 3*400/282, i.e., approximately 4.26. This indicates that it is possible to prevent the occurrence of pitch irregularity by causing the alternating electric field to act on the toner approximately 4.26 times in the secondary transfer nip. Further, when the process linear velocity v is approximately 141 mm/s, the lower limit value of the frequency f capable of preventing the occurrence of pitch irregularity is approximately 200 Hz. Therefore, the number of required waveforms is calculated as 3*200/141, i.e., approximately 4.26, which is the same value as in the frequency f of approximately 400 Hz. It is understood from the above that it is possible to obtain a favorable image free from pitch irregularity by causing the alternating electric field to act on the toner approximately four times during the passage through the secondary transfer nip. That is, a condition of $4<d*f/v$ is required to obtain a favorable image free from pitch irregularity.

Figure 5:
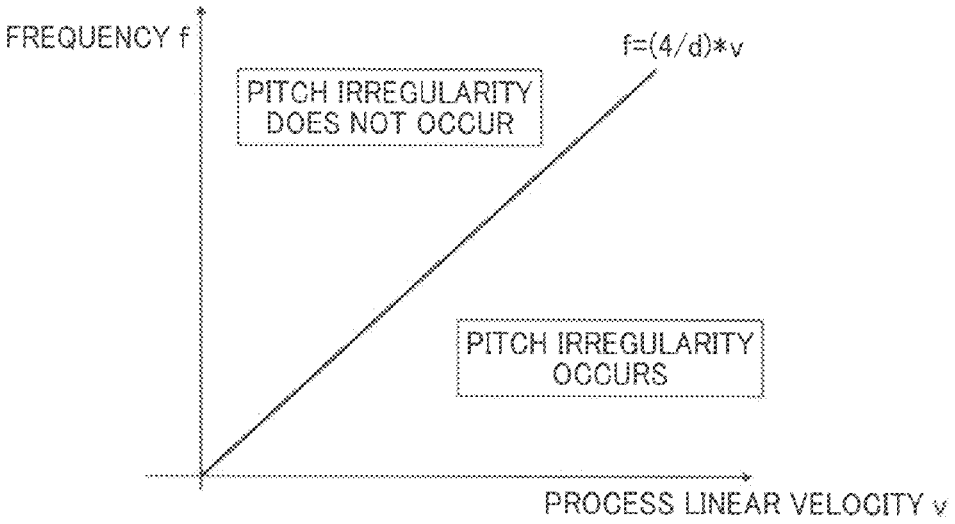
FIG. 5 is a graph illustrating a relation between a frequency of an AC component of a secondary transfer bias including a superimposed bias, a process linear velocity, and a pitch irregularity obtained in a first print test.

FIG. 5 is a graph illustrating a relation among the frequency f of the AC component of the secondary transfer bias including a superimposed bias, the process linear velocity v, and the pitch irregularity. As illustrated in the drawing, in a two-dimensional coordinate system with the y-axis representing the frequency f and the x-axis representing the process linear velocity v, pitch irregularity occurs in a region below a straight line represented by an equation of $f=(4/d)*v$. Meanwhile, the occurrence of pitch irregularity is prevented in a region above the straight line.

Subsequently, a second print test will be described.

In the present print test, a sheet of FC Japanese paper SAZANAMI (trade name) manufactured by NBS Ricoh Company, Ltd. was employed as a recording sheet P in place of a plain paper sheet. The paper SAZANAMI has surface roughness similar to surface roughness of traditional Japanese paper. An uneven density pattern conforming to the surface roughness tends to be formed on such paper. A solid black image having a length of approximately 70 mm and a width of approximately 55 mm was employed as a test image to be output. The test image output on the recording sheet P was evaluated in terms of three criteria: the density reproducibility in recesses, the density reproducibility in projections (i.e., flat portions), and the appearance of white spots attributed to discharge.

Figure 6:
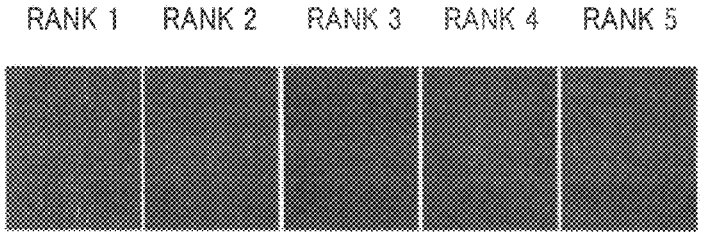
FIG. 6 is a diagram illustrating toner images of five ranks as evaluation results in terms of density reproducibility in recesses obtained in a second print test.

The evaluation in terms of the density reproducibility in recesses was performed as follows. That is, the state in which a sufficient amount of toner has entered the recesses of the surface roughness and thus a sufficient image density is obtained in the recesses was evaluated as Rank 5. The state in which a substantially small area of the recesses appears as a white area or the image density is slightly lower in the recesses than in the flat portions was evaluated as Rank 4. The state in which the white area is larger than in the state of Rank 4 or the reduction in image density is more noticeable than in the state of Rank 4 was evaluated as Rank 3. The state in which the white area is larger than in the state of Rank 3 or the reduction in image density is more noticeable than in the state of Rank 3 was evaluated as Rank 2. The state in which the recesses are overall white and grooves are overall clearly observed or the state in which the image quality is lower than in the above-described state was evaluated as Rank 1. For reference, FIG. 6 illustrates solid black images of the respective ranks. The acceptable level as the image quality to be offered to users is determined as Rank 4 or higher.

Figure 7:
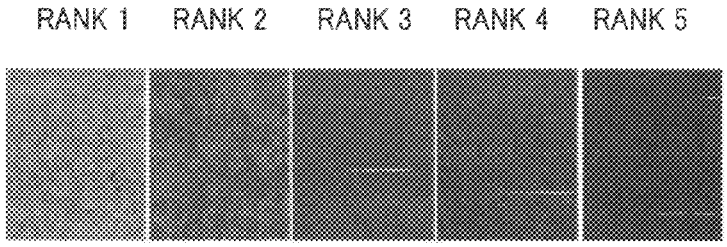
FIG. 7 is a diagram illustrating toner images of five ranks as evaluation results in terms of density reproducibility in projections obtained in the second print test.

The evaluation in terms of the density reproducibility in projections, i.e., flat portions, was performed as follows. That is, the state in which a sufficient image density is obtained in the flat portions was evaluated as Rank 5. The state in which the image density is slightly lower than in the state of Rank 5 but is the acceptable level was evaluated as Rank 4. The state in which the image density is lower than in the state of Rank 4 and is unacceptable as the image quality to be offered to users was evaluated as Rank 3. The state in which the image density is lower than in the state of Rank 3 was evaluated as Rank 2. The state in which the flat portions are overall whitish or further lower in density was evaluated as Rank 1. For reference, FIG. 7 illustrates solid black images of the respective ranks. The acceptable level as the image quality to be offered to users is determined as Rank 4 or higher.

Figure 8:
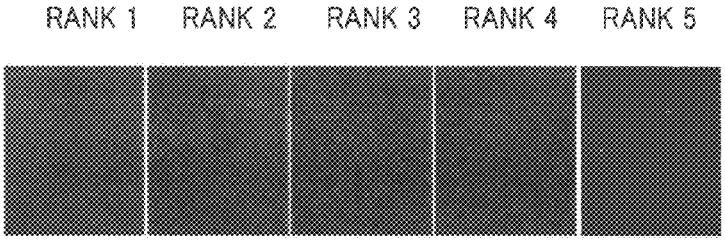
FIG. 8 is a diagram illustrating toner images of five ranks as evaluation results in terms of appearance of white spots obtained in the second print test.

In the secondary transfer nip, discharges may occur in the minute gaps formed between the recesses in the surface of the recording sheet P and the intermediate transfer belt 31 and cause the appearance of white spots in the image, depending on the secondary transfer bias. The evaluation in terms of the appearance of white spots attributed to discharge was performed as follows. That is, the state in which the white spots considered to be attributed to discharge are not observed was evaluated as Rank 5. The state in which the white spots are slightly observed but relatively small in the number and size thereof and thus are the acceptable level as the image quality to be offered to users was evaluated as Rank 4. The state in which the observed white spots are larger in number than in the state of Rank 4 and are noticeable to an unacceptable extent was evaluated as Rank 3. The state in which the observed white spots are larger in number than in the state of Rank 3 was evaluated as Rank 2. The state in which the white spots are observed in the overall image and the image quality is lower than in the state of Rank 2 was evaluated as Rank 1. The white spots attributed to discharge appear as dots, while a substantially low density in the recesses results in a white area appearing in the overall recesses. For reference, FIG. 8 illustrates solid black images of the respective ranks. The acceptable level as the image quality to be offered to users is determined as Rank 4 or higher.

The second print test was carried out as follows. That is, to first evaluate, as a reference example, a case in which there is no action of the alternating electric field in the secondary transfer nip, solid black images for test were output by application of the secondary transfer bias including only the DC component, and the output images were evaluated in terms of the above-described three criteria. The results of evaluation are presented in TABLE 2 given below.

TABLE 2

| | DC voltage (kV) | | | | | | | |
|---|---|---|---|---|---|---|---|---|
| | −1.0 | −1.5 | −2.0 | −2.5 | −3.5 | −4.0 | −4.5 | |
| Density reproducibility in recesses | 1 | 1 | 1 | 1 | 1 | 1 | 1 | Evaluation rank |
| Density reproducibility in projections | 2 | 3 | 4 | 5 | 5 | 5 | 5 | |
| Appearance of white spots | 5 | 5 | 5 | 3 | 1 | 1 | 1 | |

As illustrated in TABLE 2, if the secondary transfer bias including only the DC component is employed, the image density in the projections increases in accordance with the increase in the DC voltage, but the required image density fails to be obtained in the recesses. Irrespective of the value of the DC voltage, the output images are evaluated as Rank 1 in the density reproducibility in recesses. Further, the appearance of white spots attributed to discharge becomes more noticeable in accordance with the increase in the DC voltage. If the absolute value of the DC voltage of negative polarity is set to be larger than approximately 2.0 kV, the evaluation result in terms of the appearance of white spots falls below the acceptable level of Rank 4.

Subsequently, solid black images for test were output with the superimposed bias employed as the secondary transfer bias. The frequency f of the AC component of the superimposed bias was fixed to approximately 500 Hz. The process linear velocity v was fixed to approximately 282 mm/s. The offset voltage Voff corresponding to the voltage of the DC component was changed as appropriate within a range of from approximately −0.6 kV to approximately −2.0 kV. The peak-to-peak voltage Vpp of the AC component was changed as appropriate within a range of from approximately 1.0 kV to approximately 9.0 kV. TABLE 3 given below presents the results of evaluation of the solid black images output under the above-described conditions, as evaluated in terms of the density reproducibility in recesses.

TABLE 3

| Density reproducibility in recesses | | Vpp (kV) 1 | 2 | 3 | 4 | 5 | 6 | 7 | 8 | 9 | |
|---|---|---|---|---|---|---|---|---|---|---|---|
| Voff (kV) | −2.0 | 1 | 1 | 1 | 2 | 2 | 2 | 3 | 3 | 3 | Evaluation rank |
| | −1.8 | 1 | 1 | 1 | 2 | 2 | 3 | 3 | 4 | 4 | |
| | −1.6 | 1 | 1 | 1 | 2 | 2 | 3 | 4 | 4 | 5 | |
| | −1.4 | 1 | 1 | 2 | 2 | 3 | 4 | 4 | 5 | 5 | |
| | −1.2 | 1 | 1 | 2 | 2 | 4 | 4 | 5 | 5 | 5 | |
| | −1.0 | 1 | 1 | 2 | 3 | 4 | 5 | 5 | 5 | 5 | |
| | −0.9 | 1 | 2 | 2 | 4 | 5 | 5 | 5 | 5 | 5 | |
| | −0.8 | 1 | 2 | 2 | 4 | 5 | 5 | 5 | 5 | 5 | |
| | −0.6 | 1 | 2 | 4 | 5 | 5 | 5 | 5 | 5 | 5 | |

As illustrated in TABLE 3, the results indicate that, if the superimposed bias is employed as the secondary transfer bias, the density reproducibility in recesses can be improved to Rank 4 or higher, depending on the bias condition. The density reproducibility in recesses tends to be improved in rank in accordance with the increase in the peak-to-peak voltage Vpp of the AC component. Further, the density reproducibility in recesses tends to be improved in rank in accordance with the reduction in the absolute value of the offset voltage Voff corresponding to the DC component.

TABLE 4 given below presents the results of evaluation of the above-described solid black images, as evaluated in terms of the density reproducibility in projections.

TABLE 4

| Density reproducibility in projections | | Vpp (kV) 1 | 2 | 3 | 4 | 5 | 6 | 7 | 8 | 9 | |
|---|---|---|---|---|---|---|---|---|---|---|---|
| Voff (kV) | −2.0 | 5 | 5 | 5 | 5 | 5 | 5 | 5 | 5 | 5 | Evaluation rank |
| | −1.8 | 5 | 5 | 5 | 5 | 5 | 5 | 5 | 5 | 5 | |
| | −1.6 | 5 | 5 | 5 | 5 | 5 | 5 | 5 | 5 | 5 | |
| | −1.4 | 5 | 5 | 5 | 5 | 5 | 5 | 5 | 5 | 5 | |
| | −1.2 | 5 | 5 | 5 | 5 | 5 | 5 | 5 | 5 | 5 | |
| | −1.0 | 5 | 5 | 5 | 5 | 5 | 5 | 5 | 5 | 5 | |
| | −0.9 | 4 | 4 | 4 | 4 | 4 | 4 | 4 | 4 | 4 | |
| | −0.8 | 3 | 3 | 3 | 3 | 3 | 3 | 3 | 3 | 3 | |
| | −0.6 | 1 | 1 | 1 | 1 | 1 | 1 | 1 | 1 | 1 | |

The results indicate that the image density in the projections, i.e., flat portions, tends to be increased in accordance with the increase in the absolute value of the offset voltage Voff. It is possible to improve the density reproducibility in projections to the acceptable level of Rank 4 or higher by increasing the absolute value of the offset voltage Voff to a certain level. What is to be noticed here is that, if the superimposed bias is employed as the secondary transfer bias, the absolute value of the offset voltage Voff for improving the density reproducibility in projections to the acceptable level of Rank 4 or higher is smaller than the corresponding value in the case of employing the secondary transfer bias including only the DC component, which is illustrated in TABLE 2.

TABLE 5 given below presents the results of evaluation of the above-described solid black images, as evaluated in terms of the appearance of white spots.

TABLE 5

| Appearance of white spots | | Vpp (kV) 1 | 2 | 3 | 4 | 5 | 6 | 7 | 8 | 9 | |
|---|---|---|---|---|---|---|---|---|---|---|---|
| Voff (kV) | −2.0 | 5 | 5 | 4 | 4 | 4 | 2 | 1 | 1 | 1 | Evaluation rank |
| | −1.8 | 5 | 5 | 4 | 4 | 4 | 2 | 2 | 1 | 1 | |
| | −1.6 | 5 | 5 | 5 | 4 | 4 | 3 | 2 | 1 | 1 | |
| | −1.4 | 5 | 5 | 5 | 4 | 4 | 4 | 2 | 2 | 1 | |
| | −1.2 | 5 | 5 | 5 | 4 | 4 | 4 | 3 | 2 | 1 | |
| | −1.0 | 5 | 5 | 5 | 5 | 4 | 4 | 3 | 2 | 1 | |
| | −0.9 | 5 | 5 | 5 | 5 | 4 | 4 | 4 | 2 | 2 | |
| | −0.8 | 5 | 5 | 5 | 5 | 4 | 4 | 4 | 2 | 2 | |
| | −0.6 | 5 | 5 | 5 | 5 | 5 | 4 | 4 | 3 | 2 | |

The results indicate that the appearance of white spots attributed to discharge tends to be minimized in accordance with the reduction in the peak-to-peak voltage Vpp of the AC component, and that the appearance of white spots attributed to discharge tends to be minimized in accordance with the reduction in the absolute value of the offset voltage Voff.

Figure 9:
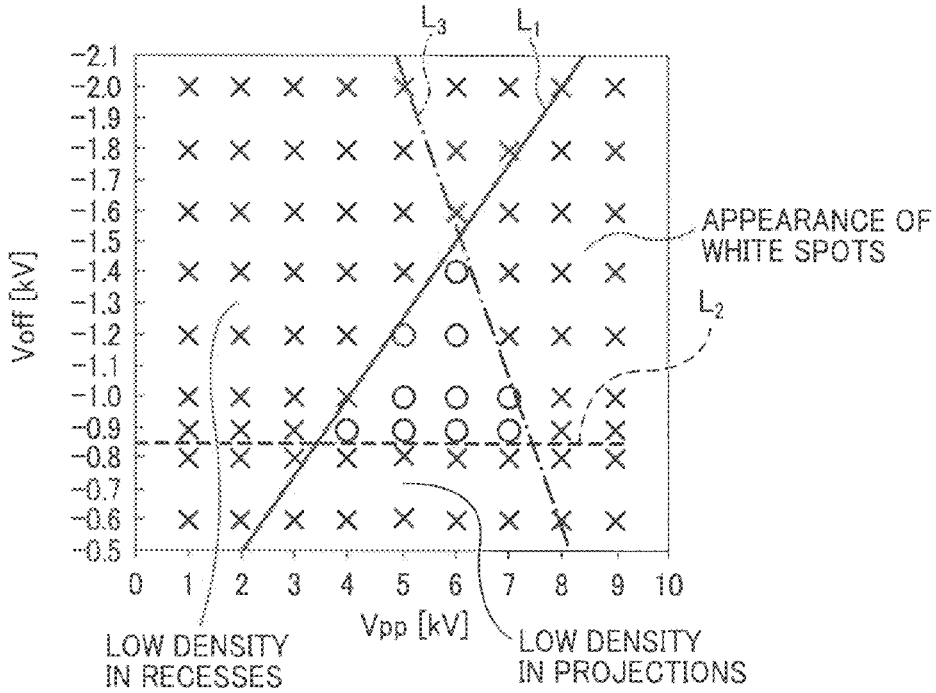
FIG. 9 is a graph illustrating a relation between an offset voltage, a peak-to-peak voltage, density reproducibility in recesses, density reproducibility in projections, and appearance of white spots, according to results of the second print test.

FIG. 9 is a graph illustrating a relation between the offset voltage Voff, the peak-to-peak voltage Vpp, the density reproducibility in recesses, the density reproducibility in projections, and the appearance of white spots, which is drawn on the basis of the results of the second print test. As illustrated in the drawing, the graph is drawn on a two-dimensional coordinate system having the y-axis representing the value of the offset voltage Voff and the x-axis representing the value of the peak-to-peak voltage Vpp. Three straight lines L1, L2, and L3 represented by the solid line, the dashed line, and the dash-dotted line, respectively, are drawn on the two-dimensional coordinate system. On the illustrated two-dimensional coordinate system, in a region corresponding to the straight line L1 or having a larger y-coordinate than the y-coordinate of the straight line L1 for the same x-coordinate, the evaluation results in terms of the density reproducibility in recesses are Rank 3 or lower, which is below the acceptable level of Rank 4. That is, a relatively low density in the recesses is noticeable in the region. Therefore, plot points in the region are represented as X. Further, in a region corresponding to the straight line L2 or having a smaller y-coordinate than the y-coordinate of the straight line L2 for the same x-coordinate, the evaluation results in terms of the density reproducibility in projections are Rank 3 or lower, which is below the acceptable level of Rank 4. That is, a relatively low density in the projections is noticeable in the region. Therefore, plot points in the region are represented as X. Further, in a region corresponding to the straight line L3 or having a larger y-coordinate than the y-coordinate of the straight line L3 for the same x-coordinate, the evaluation results in terms of the appearance of white spots are Rank 3 or lower, which is below the acceptable level of Rank 4. That is, the appearance of white spots attributed to discharge is noticeable in the region. Therefore, plot points in the region are represented as X. In a region above the straight line L1 and below the straight line L2 in the drawing, the evaluation results in terms of the density reproducibility in recesses are lower than Rank 4, and the evaluation results in terms of the density reproducibility in projections are lower than Rank 4. Further, in a region above the straight line L1 and above the straight line L3 in the drawing, the evaluation results in terms of the density reproducibility in recesses are lower than Rank 4, and the evaluation results in terms of the appearance of white spots are lower than Rank 4. Further, in a region below the straight line L2 and above the straight line L3 in the drawing, the evaluation results in terms of the density reproducibility in projections are lower than Rank 4, and the evaluation results in terms of the appearance of white spots are lower than Rank 4.

In the drawing, only plot points corresponding to the experimental results evaluated as the acceptable level of Rank 4 or higher in all of the three criteria of the density reproducibility in recesses, the density reproducibility in projections, and the appearance of white spots are represented as circles. When the focus is placed not on the three criteria but only on the density reproducibility in recesses, it is preferable to employ the combination of the offset voltage Voff and the peak-to-peak voltage Vpp having coordinates located below the straight line L1 in the drawing. The straight line L1 is represented by an equation of $Vpp=-4*Voff$. If the secondary transfer bias satisfying the condition of $\frac{1}{4}*Vpp>|Voff|$ is employed, therefore, it is possible to obtain a sufficient image density in the recesses in the sheet surface, and to minimize the uneven density pattern conforming to the irregularities of the sheet surface.

Figure 10:
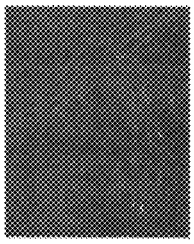
FIG. 10 is a diagram illustrating a solid black image output while applying a secondary transfer bias including only a DC voltage of approximately 2.5 kV in the second print test.
Figure 11:
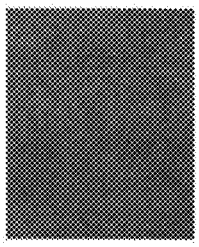
FIG. 11 is a diagram illustrating a solid black image output while employing an offset voltage of approximately −1.0 kV and a peak-to-peak voltage of approximately 5.0 kV in the second print test.

For reference, FIG. 10 illustrates the solid black image output in the experiment illustrated in TABLE 2 described above, i.e., the experiment employing the secondary transfer bias including only the DC component, under the condition of applying the DC voltage of approximately −2.5 kV, which obtained the highest image density in the recesses. Further, FIG. 11 illustrates the solid black image output under the condition of employing the offset voltage Voff of approximately −1.0 kV and the peak-to-peak voltage Vpp of approximately 5.0 kV among the potential conditions illustrated in FIG. 9. The output images indicate that, if the secondary transfer bias including the superimposed bias is employed, the density reproducibility in recesses can be substantially improved, as compared with the case employing the secondary transfer bias including only the DC component.

The foregoing background image forming apparatus employs the secondary transfer bias including the superimposed bias. The background image forming apparatus, however, is incapable of obtaining Rank 4 or higher in the density reproducibility in recesses due to the following reason. That is, in the experiment conducted with the background image forming apparatus, white area grade corresponding to the density reproducibility in recesses is evaluated under the condition of employing a voltage of 2.0 kV as Vdc corresponding to the DC component of the secondary transfer bias including the superimposed bias, a voltage in a range of from 1.0 kV to 4.0 kV as Vac of the AC component of the secondary transfer bias, and a frequency of 2.0 kHz as the frequency f of the AC component. In the experiment, the nip formation roller 36 is applied with Vdc and Vac, and the secondary transfer inner surface roller 33 is grounded, unlike the printer 301 according to the first embodiment. Further, Vdc has positive polarity to electrostatically attract toner in the secondary transfer nip from the side of the secondary transfer inner surface roller 33 toward the side of the nip formation roller 36 and thereby secondarily transfer the toner onto a recording sheet. According to the graph illustrating the results of the experiment conducted with the background image forming apparatus, the white area grade is gradually improved in accordance with the gradual increase in Vac of the AC component from 0.0 kV to 2.0 kV, and is improved most when Vac reaches 2.0 kV. The graph also indicates that, if Vac is increased to exceed 2.0 kV, the white area grade deteriorates in accordance with the increase. The maximum value of Vac illustrated in the graph is 4.0 kV, at which the evaluation result in terms of the white area grade is the lowest. The description of the experiment does not specify whether Vac of the AC component refers to the peak-to-peak voltage or the amplitude half thereof. However, the simple expression "ac" indicates the latter in many cases. Therefore, it is assumed that Vac refers to the amplitude. Further, if the condition of setting Vac to 2.0 kV, which obtains the most preferable result in the experiment of the background image forming apparatus, is replaced by the condition of the printer 301 according to the first embodiment, the offset voltage Voff is approximately −2.0 kV and the peak-to-peak voltage Vpp is approximately 4.0 kV. Further, if the condition of setting Vac to 4.0 kV, which obtains the least preferable result in the experiment of the background image forming apparatus, is replaced by the condition of the printer 301 according to the first embodiment, the offset voltage Voff is approximately −2.0 kV and the peak-to-peak voltage Vpp is approximately 8.0 kV. In view of the above conditions, the present inventors output solid black images from the print test equipment on the recording sheet P made of the paper SAZANAMI under the respective conditions described above by fixing the offset voltage Voff corresponding to the DC voltage of the superimposed bias to approximately −2.0 kV and gradually increasing the peak-to-peak voltage Vpp from approximately 1.0 kV to approximately 8.0 kV. As a result, unlike the experimental result of the background image forming apparatus, the image density in the recesses in the surface of the recording sheet P was gradually increased in accordance with the increase in the peak-to-peak voltage Vpp from approximately 1.0 kV to approximately 8.0 kV.

Figure 12:
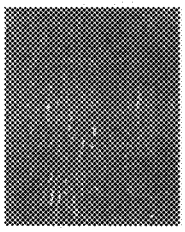
FIG. 12 is a diagram illustrating a solid black image output while applying a secondary transfer bias including only a DC voltage of approximately 2.0 kV in the second print test.
Figure 13:
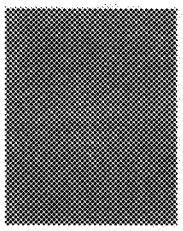
FIG. 13 is a diagram illustrating a solid black image output while applying a secondary transfer bias including a DC voltage of approximately 2.0 kV and a peak-to-peak voltage of approximately 4.0 kV in the second print test.
Figure 14:
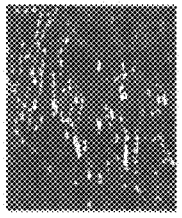
FIG. 14 is a diagram illustrating a solid black image output while applying a secondary transfer bias including a DC voltage of approximately 2.0 kV and a peak-to-peak voltage of approximately 8.0 kV in the second print test.

FIG. 12 illustrates the solid black image output in the present experiment under the condition of employing the secondary transfer bias including only the DC voltage of approximately 2.0 kV. Further, FIG. 13 illustrates the solid black image output under the condition of employing the secondary transfer bias including the DC voltage of approximately 2.0 kV and the peak-to-peak voltage Vpp of approximately 4.0 kV, i.e., the most preferable condition. According to the experiment of the background image forming apparatus, this condition is supposed to provide the most preferable result. Further, FIG. 14 illustrates the solid black image output under the condition of employing the secondary transfer bias including the DC voltage of approximately 2.0 kV, which corresponds to the offset voltage Voff of the present example, and the peak-to-peak voltage Vpp of approximately 8.0 kV. According to the experiment of the background image forming apparatus, this condition is supposed to provide the least preferable result. Each of the solid black images has a length of approximately 70 mm and a width of approximately 55 mm. If the focus is placed only on the density reproducibility in recesses, the most preferable result is obtained in the solid black image illustrated in FIG. 13 among the three solid black images. At a glance, the solid black image appears to have a substantial deficiency in image density in the recesses. However, white areas appearing to be groove-like recesses are substantially wider than groove-like recesses of FIG. 12. This indicates that the white areas are not caused by a deficiency in image density in the recesses, but are a multitude of linearly connected white spots attributed to discharge. The linearly connected white spots particularly appear along relatively deep portions of the recesses in the sheet surface. In relatively shallow portions of the recesses, the image density is higher than in the recesses of FIG. 12. Even the higher image density, however, is evaluated as Rank 3 below the acceptable level.

In the condition of employing the offset voltage Voff of approximately 2.0 kV and the peak-to-peak voltage Vpp of approximately 4.0 kV, which obtained the solid black image of FIG. 13, a relation between the two voltages is represented by an equation of $\frac{1}{2}*Vpp=|Voff|$. This condition substantially deviates from the condition of $\frac{1}{4}*Vpp>|Voff|$ derived from the second print test by the present inventors. Further, in the condition of employing the offset voltage Voff of approximately 2.0 kV and the peak-to-peak voltage Vpp of approximately 8.0 kV, which obtained the solid black image of FIG. 14, a relation between the two voltages is represented by an equation of $\frac{1}{4}*Vpp=|Voff|$. This condition is close to but slightly deviates from the condition of $\frac{1}{4}*Vpp>|Voff|$ derived from the second print test by the present inventors. While the condition of $\frac{1}{4}*Vpp=|Voff|$ obtained Rank 3 in the density reproducibility in recesses, the condition of $\frac{1}{4}*Vpp>|Voff|$ was able to obtain Rank 4 in the density reproducibility in recesses. It was found from the above that it is necessary to set the condition of $\frac{1}{4}*Vpp>|Voff|$ to obtain at least Rank 4 in the density reproducibility in recesses.

In the print test equipment, the secondary transfer inner surface roller 33 is supplied with the secondary transfer bias, and the nip formation roller 36 is grounded. Therefore, the value of the offset voltage Voff corresponding to the time-averaged value of the potential difference between the two rollers is substantially equal to the value of the DC component of the secondary transfer bias. Meanwhile, if the nip formation roller 36 is not grounded but is applied with a DC voltage, the time-averaged value of the potential difference between the two rollers is different from the value of the offset voltage Voff. The movement of toner particles between the intermediate transfer belt 31 and the recording sheet P in the secondary transfer nip is related not to the DC component of the secondary transfer bias per se but to the time-averaged value of the potential difference between the two rollers. Accordingly, it is not the condition of $\frac{1}{4}*Vpp>|Voff|$ but the condition of $\frac{1}{4}*Vpp>|Ta|$ where Ta represents the time-averaged value, which should be satisfied by the secondary transfer bias.

Methods of generating, between a first rotary body such as the nip formation roller 36 and a second rotary body such as the secondary transfer inner surface roller 33, the potential difference including the DC component and the AC component include the following six methods, for example. According to a first method, the first rotary body is applied with a superimposed bias, and the second rotary body is grounded. According to a second method, the first rotary body is applied with a superimposed bias, and the second rotary body is applied with a DC bias. According to a third method, the first rotary body is applied with an AC bias including only an AC component, and the second rotary body is applied with a DC bias. According to a fourth method, the first rotary body is grounded, and the second rotary body is applied with a superimposed bias. According to a fifth method, the first rotary body is applied with a DC bias, and the second rotary body is applied with a superimposed bias. According to a sixth method, the first rotary body is applied with a DC bias, and the second rotary body is applied with an AC bias including only an AC component.

In the second and fifth methods described above, the term "DC component" refers to a superimposed value corresponding to the sum of the DC component of the superimposed bias and the DC bias. For example, if the first rotary body is applied with a superimposed bias including a peak-to-peak voltage Vpp of approximately 8.0 kV and a DC component of approximately +0.5 kV and the second rotary body is applied with a DC bias of approximately −0.5 kV, the term "DC component" refers to the sum of approximately 0.5 kV and approximately 0.5 kV, i.e., approximately 1.0 kV.

Subsequently, description is given of an observation experiment conducted by the present inventors.

Figure 15:
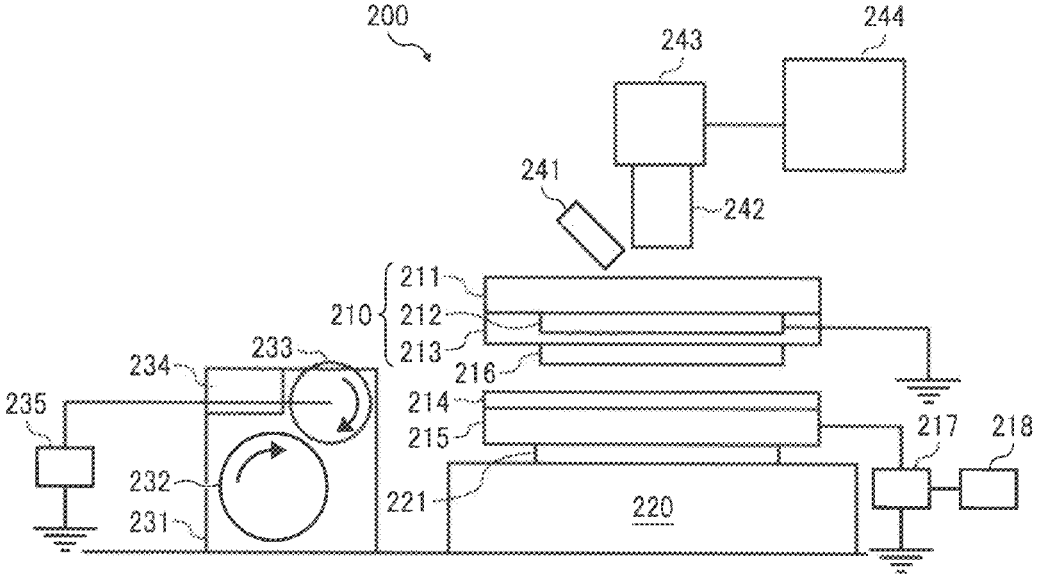
FIG. 15 is a schematic configuration diagram illustrating observation experiment equipment used in experiments described in this patent specification.

To find the cause for allowing the condition of ¼*Vpp>|Voff| to provide a sufficient image density in the recesses and make the uneven density pattern conforming to the irregularities of the sheet surface less noticeable, the present inventors produced special observation experiment equipment 200 shown in FIG. 15.

FIG. 15 is a schematic configuration diagram illustrating the observation experiment equipment 200. The observation experiment equipment 200 includes a transparent substrate 210, a metal plate 215, a substrate 221, a development device 231, a power supply 235, a Z stage 220, a light source 241, a microscope 242, a high-speed camera 243, a personal computer 244, a voltage amplifier 217, a waveform generator 218, and so forth. The transparent substrate 210 includes a glass plate 211, a transparent electrode 212 made of ITO (Indium Tin Oxide) and disposed on a lower surface of the glass plate 211, and a transparent insulating layer 213 made of a transparent material covering the transparent electrode 212. The transparent substrate 210 is supported at a predetermined height position by a substrate support. The substrate support is allowed to move in the vertical and horizontal directions in the drawing by a moving assembly. In the illustrated example, the transparent substrate 210 is located above the Z stage 220 having the metal plate 215 placed thereon. The transparent substrate 210 is capable of moving to a position directly above the development device 231 disposed lateral to the Z stage 220, in accordance with the movement of the substrate support. The transparent electrode 212 of the transparent substrate 210 is connected to a grounded electrode fixed to the substrate support.

The development device 231 is similar in configuration to the development device 8K depicted in FIG. 4 of the printer 301 according to the first embodiment, and includes a screw 232, a development roll 233, a doctor blade 234, and so forth. The development roll 233 is driven to rotate with a development bias applied thereto by the power supply 235.

In accordance with the movement of the substrate support, the transparent substrate 210 is moved at a predetermined speed to a position directly above the development device 231 and disposed opposite the development roll 233 via a predetermined gap. Then, toner on the development roll 233 is transferred to the transparent electrode 212 of the transparent substrate 210. Thereby, a toner layer 216 having a predetermined thickness is formed on the transparent electrode 212 of the transparent substrate 210. The toner adhesion amount per unit area in the toner layer 216 is adjustable by the toner concentration in the developer, the toner charge amount, the development bias value, the gap between the transparent substrate 210 and the development roll 233, the moving speed of the transparent substrate 210, the rotation speed of the development roll 233, and so forth.

The transparent substrate 210 formed with the toner layer 216 is translated to a position disposed opposite a recording sheet 214 bonded to the planar metal plate 215 by a conductive adhesive. The metal plate 215 is placed on the substrate 221, which is provided with a load sensor and placed on the Z stage 220. Further, the metal plate 215 is connected to the voltage amplifier 217. The waveform generator 218 inputs to the voltage amplifier 217 a transfer bias including a DC voltage and an AC voltage. The transfer bias is amplified by the voltage amplifier 217 and applied to the metal plate 215. If the Z stage 220 is drive-controlled and elevates the metal plate 215, the recording sheet 214 starts coming into contact with the toner layer 216. If the metal plate 215 is further elevated, pressure applied to the toner layer 216 is increased. The elevation of the metal plate 215 is stopped when the output from the load sensor reaches a predetermined value. With the pressure maintained at the predetermined value, a transfer bias is applied to the metal plate 215, and the behavior of the toner is observed. After the observation, the Z stage 220 is drive-controlled to lower the metal plate 215 and separate the recording sheet 214 from the transparent substrate 210. Thereby, the toner layer 216 is transferred onto the recording sheet 214.

The observation of the behavior of the toner is carried out with the microscope 242 and the high-speed camera 243 disposed above the transparent substrate 210. The transparent substrate 210 is constructed of the layers of the glass plate 211, the transparent electrode 212, and the transparent insulating layer 213, which are all made of transparent material. It is therefore possible to observe, from above and through the transparent substrate 210, the behavior of the toner located under the transparent substrate 210.

In the present experiment, a microscope using a zoom lens VH-Z75 manufactured by Keyence Corporation was used as the microscope 242. Further, a camera FASTCAM-MAX 120KC manufactured by Photron Limited was used as the high-speed camera 243 drive-controlled by the personal computer 244. The microscope 242 and the high-speed camera 243 are supported by a camera support configured to adjust the focus of the microscope 242.

The behavior of the toner was photographed as follows. That is, illumination light was applied by the light source 241 to the position for observing the behavior of the toner, and the focus of the microscope 242 was adjusted. Then, a transfer bias was applied to the metal plate 215 to cause the toner in the toner layer 216 adhering to a lower surface of the transparent substrate 210 to move toward the recording sheet 214. The behavior of the toner in this process was photographed by the high-speed camera 243.

The observation experiment equipment 200 illustrated in FIG. 15 and the printer 301 according to the first embodiment are different in the structure of the transfer nip in which toner is transferred onto a recording sheet. Therefore, the transfer electric field acting on the toner is different therebetween, even if the applied transfer bias is the same. To find appropriate observation conditions, transfer bias conditions allowing the observation experiment equipment 200 to attain favorable density reproducibility in recesses were investigated. As the recording sheet 214, a 260 kg (ream weight of a thousand sheets of 788 mm by 1,091 mm size) type of paper Leathac 66 (trade name) manufactured by Tokushu Paper Mfg. Co., Ltd. was used. The paper Leathac 66 is larger in the degree of surface roughness than the paper SAZANAMI. As the toner, Y toner having an average toner particle diameter of approximately 6.8 μm mixed with a relatively small amount of K toner was used. The observation experiment equipment 200 is configured to apply the transfer bias to a back side surface of the recording sheet 214. In the observation experiment equipment 200, therefore, the polarity of the transfer bias capable of transferring the toner onto the recording sheet 214 is opposite the polarity of the transfer bias employed in the printer 301 according to the first embodiment (i.e., positive polarity). As the AC component of the transfer bias including a superimposed bias, an AC component having a sinusoidal waveform was employed. The toner layer 216 was transferred onto the recording sheet 214 with a toner adhesion amount in a range of from approximately 0.4 mg/cm$^2$ (milligrams per square centimeter) to approximately 0.5 mg/cm$^2$, with the frequency f of the AC component set to approximately 500 Hz, the offset voltage Voff set to approximately 200 V, and the peak-to-peak voltage Vpp changed from approximately 400 V to approximately 2,600 V in units of approximately 200 V. As a result, a rank lower than Rank 4 was obtained in the density reproducibility in recesses under the condition of setting the peak-to-peak voltage Vpp to less than approximately 800 V. Under the condition of setting the peak-to-peak voltage Vpp in a range of from approximately 800 V to approximately 2,200 V, however, Rank 4 or higher was obtained in the density reproducibility in recesses. That is, the observation experiment equipment 200 serving as a transfer test device also succeeded in improving the density reproducibility in recesses to the acceptable level with the condition of ¼*Vpp>|Voff|, similarly as in the print test equipment. Under the condition of setting the peak-to-peak voltage Vpp to approximately 2,400 V, the acceptable level of density reproducibility in recesses was obtained, but the appearance of white spots occurred to an extent exceeding the acceptable level.

Figure 16:
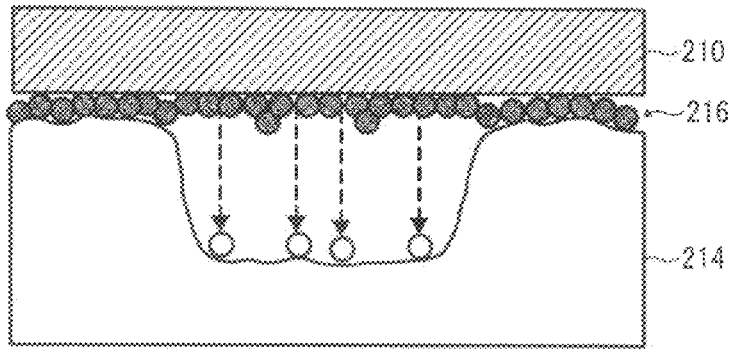
FIG. 16 is an enlarged schematic view illustrating the behavior of toner in a secondary transfer nip of the observation experiment equipment shown in FIG. 15 at an initial transfer stage.
Figure 17:
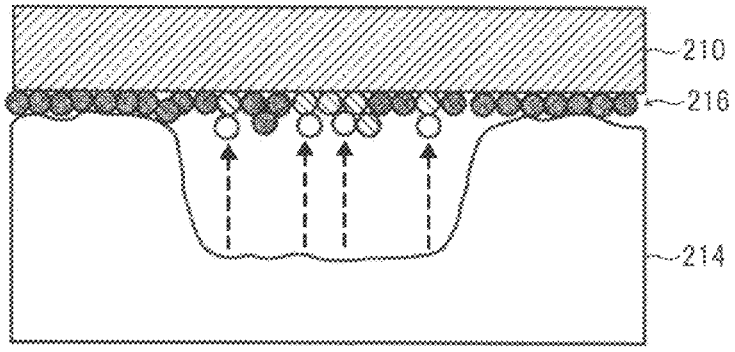
FIG. 17 is an enlarged schematic view illustrating the behavior of toner in the secondary transfer nip of the observation experiment equipment shown in FIG. 15 at an intermediate transfer stage.
Figure 18:
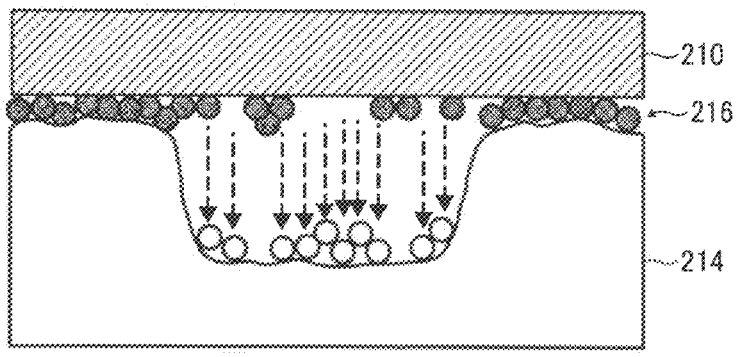
FIG. 18 is an enlarged schematic view illustrating the behavior of toner in the secondary transfer nip of the observation experiment equipment shown in FIG. 15 at a final transfer stage.

Subsequently, the behavior of the toner was photographed under the condition of setting the offset voltage Voff and the peak-to-peak voltage Vpp to approximately 200 V and approximately 1,000 V, respectively, i.e., under the condition of ¼*Vpp>|Voff|, with the microscope 242 focused on the toner layer 216 on the transparent substrate 210, and the following phenomenon was observed. That is, the toner particles in the toner layer 216 moved back and forth between the transparent substrate 210 and the recording sheet 214 owing to an alternating electric field generated by the AC component of the transfer bias. In accordance with an increase in the number of the back-and-forth movements, the number of toner particles moving back and forth was increased. Specifically, in the transfer nip, there was an action of the alternating electric field and a back-and-forth movement of toner particles in every cycle 1/f of the AC component of the transfer bias. In the first cycle, only toner particles present on a surface of the toner layer 216 separated from the toner layer 216, as illustrated in FIG. 16. The toner particles then entered the recesses in the recording sheet 214, and thereafter returned to the toner layer 216, as illustrated in FIG. 17. In this process, the returning toner particles collided with other toner particles remaining in the toner layer 216, and thereby reduced the adhesion of the other toner particles to the toner layer 216 or the transparent substrate 210. In the next cycle, therefore, a larger number of toner particles than in the last cycle separated from the toner layer 216, as illustrated in FIG. 18. Then, the toner particles entered the recesses in the recording sheet 214, and thereafter returned to the toner layer 216. In this process, the returning toner particles collided with other toner particles still remaining in the toner layer 216, and thereby reduced the adhesion of the other toner particles to the toner layer 216 or the transparent substrate 210. In the next cycle, therefore, a still larger number of toner particles than in the last cycle separated from the toner layer 216. In the above-described manner, the number of toner particles moving back and forth was gradually increased in every back-and-forth movement. After the lapse of a nip passage time, i.e., a time corresponding to the actual nip passage time in the observation experiment equipment 200, a sufficient amount of toner had been transferred to the recesses in the recording sheet 214. The phenomenon described above was revealed from the experiment.

Further, the behavior of the toner was photographed under the condition of setting the offset voltage Voff and the peak-to-peak voltage Vpp to approximately 200 V and approximately 800 V, respectively, i.e., the condition not satisfying the relation of ¼*Vpp>|Voff|, and the following phenomenon was observed. That is, some of the toner particles in the toner layer 216 present on the surface thereof separated from the toner layer 216 in the first cycle, and entered the recesses in the recording sheet 214. Thereafter, however, the toner particles in the recesses remained therein, without returning to the toner layer 216. In the next cycle, a very small number of toner particles newly separated from the toner layer 216 and entered the recesses in the recording sheet 214. After the lapse of the nip passage time, therefore, only a relatively small number of toner particles had been transferred to the recesses in the recording sheet 214.

As described above, it was found that, if the transfer bias satisfies the condition of ¼*Vpp>|Voff|, the phenomenon as illustrated in FIGS. 16 to 18 is caused to allow a sufficient amount of toner to be transferred into the recesses in the recording sheet 214. To cause the phenomenon as illustrated in FIGS. 16 to 18, it is necessary to cause at least two cycles of back-and-forth movement of the toner particles in the transfer nip. Accordingly, the nip passage time needs to be set to at least twice the cycle of the AC component. As described above, it is desirable to cause the alternating electric field to act in the transfer nip at least four times, i.e., f>(4/d)*v.

Subsequently, a third print test will be described.

In the present print test, the 260 kg (ream weight) type of paper Leathac 66 manufactured by Tokushu Paper Mfg. Co., Ltd. was used as the recording sheet P. Similarly as in the second print test, solid black images having a length of approximately 70 mm and a width of approximately 55 mm were output, and the output images were evaluated in terms of the three criteria, i.e., the density reproducibility in recesses, the density reproducibility in projections (i.e., flat portions), and the appearance of white spots attributed to discharge. The offset voltage Voff was changed within a range of from approximately −0.6 kV to approximately −1.5 kV. The peak-to-peak voltage Vpp was changed within a range of from approximately 2.1 kV to approximately 9.0 kV.

Figure 19:
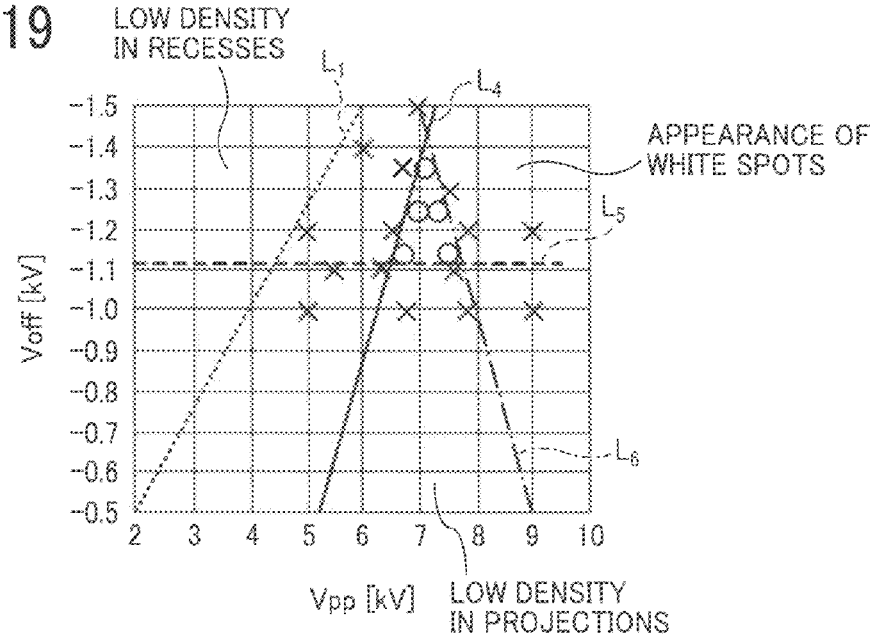
FIG. 19 is a graph illustrating a relation between an offset voltage, a peak-to-peak voltage, density reproducibility in recesses, density reproducibility in projections, and appearance of white spots, according to results of a third print test.

FIG. 19 is a graph illustrating a relation among the offset voltage Voff, the peak-to-peak voltage Vpp, the density reproducibility in recesses, the density reproducibility in projections, and the appearance of white spots, according to the results of the third print test. On the illustrated two-dimensional coordinate system, in a region corresponding to a straight line L4 or having a larger y-coordinate than the y-coordinate of the straight line L4 for the same x-coordinate, the evaluation results in terms of the density reproducibility in recesses are Rank 3 or lower, which is below the acceptable level of Rank 4. That is, a relatively low density in the recesses is noticeable in the region. Therefore, plot points in the region are represented as X. Further, in a region corresponding to a straight line L5 or having a smaller y-coordinate than the y-coordinate of the straight line L5 for the same x-coordinate, the evaluation results in terms of the density reproducibility in projections are Rank 3 or lower, which is below the acceptable level of Rank 4. That is, a relatively low density in the projections is noticeable in the region. Therefore, plot points in the region are represented as X. Further, in a region corresponding to a straight line L6 or having a larger y-coordinate than the y-coordinate of the straight line L6 for the same x-coordinate, the evaluation results in terms of the appearance of white spots are Rank 3 or lower, which is below the acceptable level of Rank 4. That is, the appearance of white spots attributed to discharge is noticeable in the region. Therefore, plot points in the region are represented as X. In a region above the straight line L4 and below the straight line L5 in the drawing, the evaluation results in terms of the density reproducibility in recesses are lower than Rank 4, and the evaluation results in terms of the density reproducibility in projections are lower than Rank 4. Further, in a region above the straight line L4 and above the straight line L6 in the drawing, the evaluation results in terms of the density reproducibility in recesses are lower than Rank 4, and the evaluation results in terms of the appearance of white spots are lower than Rank 4. Further, in a region below the straight line L5 and above the straight line L6 in the drawing, the evaluation results in terms of the density reproducibility in projections are lower than Rank 4, and the evaluation results in terms of the appearance of white spots are lower than Rank 4.

As illustrated in the drawing, the phenomenon in which favorable images are obtained only in the triangular region surrounded by the three straight lines is similar to the results of the second print test illustrated in FIG. 9 described above. However, the present print test is different from the second print test in, for example, the slope of the straight line L4 corresponding to the straight line L1 of the second print test. For reference, the straight line L1 as one of the experimental results of the second print test is illustrated in FIG. 19 as the dotted line.

Subsequently, a fourth print test will be described.

In the present print test, a 175 kg (ream weight) type of paper Leathac 66 manufactured by Tokushu Paper Mfg. Co., Ltd. was used as the recording sheet P. The recesses in a surface of the 175 kg type of paper Leathac 66 are deeper than the recesses in a surface of the above-described paper SAZANAMI, but are shallower than the recesses in a surface of the 260 kg (ream weight) type of paper Leathac 66 used in the third print test. Similarly as in the second print test, solid black images having a length of approximately 70 mm and a width of approximately 55 mm were output, and the output images were evaluated in terms of the three criteria, i.e., the density reproducibility in recesses, the density reproducibility in projections (i.e., flat portions), and the appearance of white spots attributed to discharge. The offset voltage Voff was changed within a range of from approximately −0.6 kV to approximately −1.5 kV. The peak-to-peak voltage Vpp was changed within a range of from approximately 2.1 kV to approximately 8.0 kV.

Figure 20:
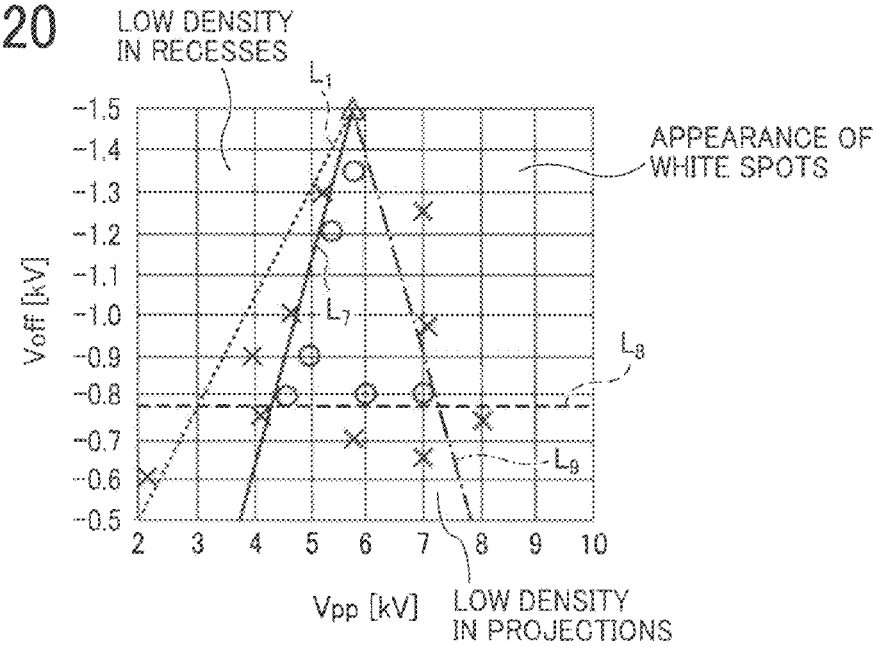
FIG. 20 is a graph illustrating a relation between an offset voltage, a peak-to-peak voltage, density reproducibility in recesses, density reproducibility in projections, and appearance of white spots, according to results of a fourth print test.

FIG. 20 is a graph illustrating a relation between the offset voltage Voff, the peak-to-peak voltage Vpp, the density reproducibility in recesses, the density reproducibility in projections, and the appearance of white spots, according to the results of the fourth print test. On the illustrated two-dimensional coordinate system, in a region corresponding to a straight line L7 or having a larger y-coordinate than the y-coordinate of the straight line L7 for the same x-coordinate, the evaluation results in terms of the density reproducibility in recesses are Rank 3 or lower, which is below the acceptable level of Rank 4. That is, a relatively low density in the recesses is noticeable in the region. Therefore, plot points in the region are represented as X. Further, in a region corresponding to a straight line L8 or having a smaller y-coordinate than the y-coordinate of the straight line L8 for the same x-coordinate, the evaluation results in terms of the density reproducibility in projections are Rank 3 or lower, which is below the acceptable level of Rank 4. That is, a relatively low density in the projections is noticeable in the region. Therefore, plot points in the region are represented as X. Further, in a region corresponding to a straight line L9 or having a larger y-coordinate than the y-coordinate of the straight line L9 for the same x-coordinate, the evaluation results in terms of the appearance of white spots are Rank 3 or lower, which is below the acceptable level of Rank 4. That is, the appearance of white spots attributed to discharge is noticeable in the region. Therefore, plot points in the region are represented as X. In a region above the straight line L7 and below the straight line L8 in the drawing, the evaluation results in terms of the density reproducibility in recesses are lower than Rank 4, and the evaluation results in terms of the density reproducibility in projections are lower than Rank 4. Further, in a region above the straight line L7 and above the straight line L9 in the drawing, the evaluation results in terms of the density reproducibility in recesses are lower than Rank 4, and the evaluation results in terms of the appearance of white spots are lower than Rank 4. Further, in a region below the straight line L8 and above the straight line L9 in the drawing, the evaluation results in terms of the density reproducibility in projections are lower than Rank 4, and the evaluation results in terms of the appearance of white spots are lower than Rank 4.

As illustrated in the drawing, the phenomenon in which favorable images are obtained only in the triangular region surrounded by the three straight lines is similar to the results of the second print test illustrated in FIG. 9 and the results of the third print test illustrated in FIG. 19 described above. However, the present print test is different from the second and third print tests in the slopes of the respective straight lines. For reference, the straight line L1 as one of the experimental results of the second print test is illustrated in FIG. 20 as the dotted line.

As described above, in the second print test of FIG. 9 described above, if the combination of the offset voltage Voff and the peak-to-peak voltage Vpp (hereinafter referred to as the Voff-Vpp combination) does not have coordinates located below the straight line L1 in the drawing, the image density in the recesses in the surface of the recording sheet P is reduced, and the uneven density pattern is emphasized. Further, in the fourth print test of FIG. 20 described above, if the Voff-Vpp combination does not have coordinates located below the straight line L7 in the drawing, the image density in the recesses in the surface of the recording sheet P is reduced, and the uneven density pattern is emphasized. Further, in the third print test of FIG. 19 described above, if the Voff-Vpp combination does not have coordinates located below the straight line L4 in the drawing, the image density in the recesses in the surface of the recording sheet P is reduced, and the uneven density pattern is emphasized. Among the recording sheets used in the experiments, the depth of the recesses in the surface of the recording sheet P increases in the order of the second print test of FIG. 9, the fourth print test of FIG. 20, and the third print test of FIG. 19. This indicates that the deeper are the recesses, the larger is the value of the slope of the straight line L1, L4, or L7 representing the borderline of ability to transfer a sufficient amount of toner into the recesses. Further, as for the straight lines L1, L4, and L7, it is observed that the region located below the straight line L4 and the region located below the straight line L7 are both included in the region located below the straight line L1. This means that, if a sheet with surface roughness, such as a Japanese paper sheet, is used as the recording sheet P, it is necessary to adopt at least the potential condition, i.e., the Voff−Vpp combination, located below the straight line L1.

Subsequently, a fifth print test will be described.

According to a background image forming apparatus, an AC voltage having a peak-to-peak voltage Vpp of 2.1 kV and a frequency f of 2.0 kHz and superimposed on an offset voltage Voff of 0.6 kV is employed as the transfer bias. The peak-to-peak voltage Vpp of 2.1 kV divided by four is 0.525, which is less than 0.6. In the background image forming apparatus, therefore, the transfer bias does not satisfy the condition of ¼*Vpp>|Voff|. According to the experimental results described so far, it is predicted that the background image forming apparatus will form an uneven density pattern on a sheet, even if the sheet is the paper SAZANAMI having relatively shallow recesses. To verify the prediction, the present inventors actually output a solid black image under the voltage condition according to the background image forming apparatus. As a result, the output image was evaluated as Rank 1 in the density reproducibility in recesses, which is a substantially undesirable result.

Subsequently, description is given of a recess depth measurement test.

In the case of a recording sheet having relatively shallow recesses, such as the paper SAZANAMI, the condition which should be satisfied by the transfer bias is simply that the Voff-Vpp combination has coordinates located below the straight line L1, i.e., the condition of ¼*Vpp>|Voff|. In the case of a recording sheet having relatively deep recesses, however, the transfer bias simply satisfying the condition of ¼*Vpp>|Voff| results in the transfer of an insufficient amount of toner into the recesses. Therefore, it is necessary to narrow the region of the appropriate potential condition to, for example, the region below the straight line L7 and then to the region below the straight line L4 in accordance with the increase in depth of the recesses. The slope of the straight line is increased in the order of L1<L7<L4, and the proportion of the offset voltage Voff to the peak-to-peak voltage Vpp is reduced in this order. As illustrated in FIG. 2, the value obtained by subtraction of the offset voltage Voff from an amplitude ½*Vpp corresponds to a returning peak value Vr. Therefore, the need to reduce the proportion of the offset voltage Voff to the peak-to-peak voltage Vpp in accordance with the increase in depth of the recesses indicates the need to increase the returning peak value Vr in accordance with the increase in depth of the recesses.

In view of the above, the present inventors decided to investigate a relation between the depth of the recesses and the minimum value of the returning peak value Vr capable of transferring a sufficient amount of toner into the recesses (hereinafter referred to as the appropriate Vr lower limit value). The investigation requires previous measurement of the recess depths of respective types of recording sheets. Therefore, the recess depths of the respective types of recording sheets were first measured.

As a measurement equipment, SURFCOM 1400D manufactured by Tokyo Seimitsu Co., Ltd. was used. As for measurement points, a surface of each of the recording sheets was observed with a microscope, and five test regions were selected at random from the entire surface. For each of the regions, a maximum profile height Pt (according to JIS B 0601: 2001) of a profile curve was measured under the condition of using an evaluation length of approximately 20 mm and a reference length of approximately 20 mm. Then, three highest values were selected from the thus obtained five values of the maximum profile height Pt, and the mean value of the three highest values was calculated. The above-described operation was performed on three recording sheets of the same type, and the mean of the above-described mean values of the three recording sheets was calculated as a maximum recess depth D.

The present test used, as the recording sheets, the following six types of sheets: the 260 kg type, the 215 kg type, the 175 kg type, the 130 kg type, and the 100 kg type (each in ream weight) of paper Leathac 66 manufactured by Tokushu Paper Mfg. Co., Ltd. and the FC Japanese paper SAZANAMI manufactured by NBS Ricoh Company, Ltd. For each of the six types of recording sheets, the maximum recess depth D was measured in the above-described manner.

Figure 21:
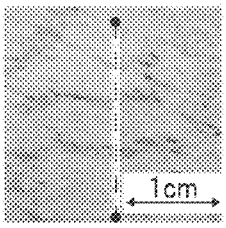
FIG. 21 is a diagram illustrating an enlarged photographic image of a surface of paper Leathac 66 (260 kg ream weight) in a fifth print test.
Figure 22:
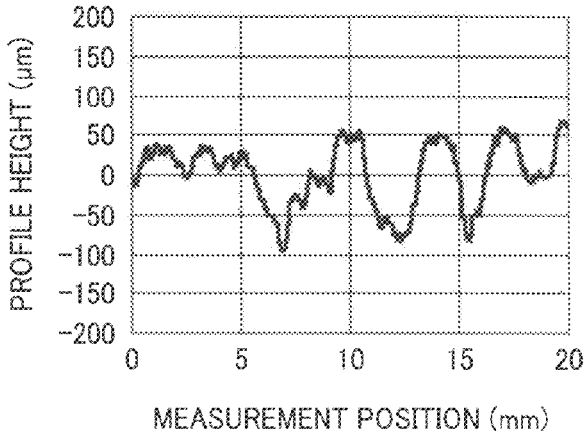
FIG. 22 is a graph illustrating an example of a profile curve of the paper Leathac 66 (260 kg ream weight) in the fifth print test.
Figure 23:
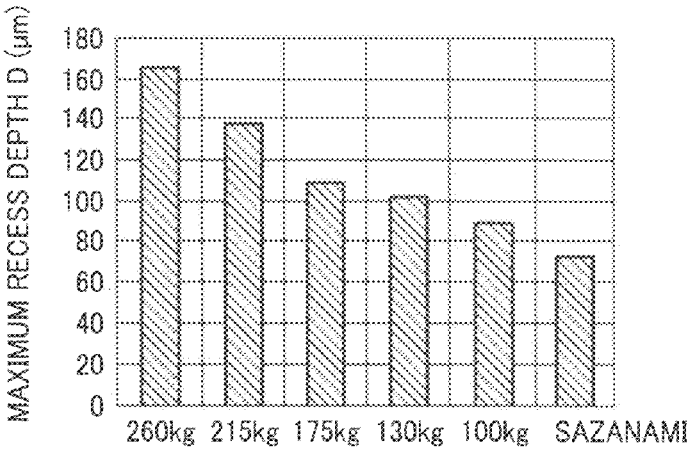
FIG. 23 is a graph illustrating maximum recess depths of various types of recording sheets in the fifth print test.

FIG. 21 illustrates an enlarged photographic image of a surface of the 260 kg (ream weight) type of paper Leathac 66. The profile height of the paper was measured along an orbit indicated by the broken line in the drawing. In the illustrated orbit, the profile curve illustrated in FIG. 22 was obtained. FIG. 23 illustrates the results of measurement of the maximum recess depth D measured for the six types of recording sheets on the basis of profile curves, such as the above-described profile curve.

Subsequently, a sixth print test will be described.

Figure 24:
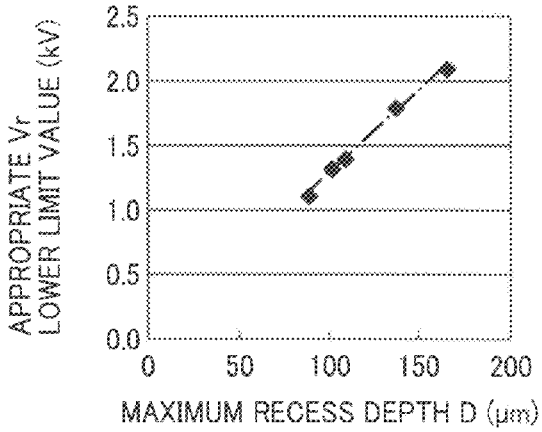
FIG. 24 is a graph illustrating a relation between an appropriate lower limit value of a returning peak value and a maximum recess depth in a sixth print test.

For each of the six types of recording sheets illustrated in FIG. 23, the appropriate Vr lower limit value was examined as follows. That is, solid black images were output under respective conditions of the returning peak value Vr of the transfer bias, in which the returning peak value Vr was set to different values. Then, the output images were evaluated in terms of the density reproducibility in recesses, and only the returning peak values Vr corresponding to the evaluation results of Rank 4 or higher were extracted as appropriate data. From the thus obtained appropriate data, the lowest value was determined as the appropriate Vr lower limit value. On the basis of the maximum recess depths D and the appropriate Vr lower limit values obtained for the six types of recording sheets, it was confirmed that a relation between the maximum recess depth D and the appropriate Vr lower limit value is represented by a straight line of a linear function illustrated in FIG. 24.

To obtain the straight line of the linear function illustrated in the drawing, however, a toner image potential Vtoner representing the potential of the toner image on the intermediate transfer belt 31 needs to be constant. If the toner image potential Vtoner changes, the transfer efficiency changes. Therefore, the appropriate Vr lower limit value also changes. In view of this, the present inventors output solid black images on the same type of recording sheets while changing the toner image potential Vtoner and the bias condition, and evaluated the output images in terms of the density reproducibility in recesses. As a result, it was found that a relation represented by the straight line of the linear function is also established between the appropriate Vr lower limit value and the toner image potential Vtoner. Further, it was found from more detailed experiments that it is possible to express the appropriate Vr lower limit value by an equation of Vrl=0.17*D*|Vtoner| where Vrl represents the appropriate Vr lower limit value, D represents the maximum recess depth, and Vtoner represents the toner image potential, as illustrated by a graph of FIG. 25.

The toner image potential Vtoner is determined as follows. That is, when a toner image of a single color of black is formed, the toner image potential Vtoner is determined as the surface potential of a solid black image having a single color of black. Herein, the term "solid black image" refers to an image, in which the pixels in the entirety of a 1 cm by 1 cm area have respective black pixel values. The solid black image has a similar image structure to the image structure of an all-black image created by imaging software Photoshop by Adobe Systems Incorporated in the monochrome two-tone mode and printed out as a solid image from a PostScript-compliant printer driver. Meanwhile, when a color image is formed, the toner image potential Vtoner is determined as the surface potential of a toner layer on the intermediate transfer belt 31, which is formed by a two-color solid image including superimposed magenta and cyan images transferred to the intermediate transfer belt 31 in a superimposed manner. In this case, the term "two-color solid image" refers to an image having a similar image structure to the image structure of a superimposed image of an all-magenta image and an all-cyan image created by Photoshop by Adobe Systems Incorporated in the CMYK color mode, subjected to the same laser writing process, and printed out as a toner image. The reason for using the image similar in image structure to the solid image created by Photoshop by Adobe Systems Incorporated with the use of a PostScript-compliant printer driver is that PostScript is one of the most common data description standards used for, for example, DTP (Desk Top Publishing).

Subsequently, characteristic configurations of the printer 301 according to the first embodiment will be described.

In FIG. 3 described above, the printer 301 according to the first embodiment includes the control panel 50 serving as a type acquisition device and the controller 60. The control panel 50 includes a touch panel and a plurality of key buttons. The control panel 50 displays an image on a screen of the touch panel, and receives an instruction from a user input with the touch panel or the key buttons. The control panel 50 displays an image on the touch panel on the basis of a control signal transmitted from the controller 60.

The controller 60 includes a CPU (Central Processing Unit), a RAM (Random Access Memory), a ROM (Read-Only Memory), a flash memory, and so forth. The controller 60 controls the driving of a variety of devices included in the printer 301, and performs operation processing. The flash memory of the controller 60 stores a data table as illustrated in TABLE 6 given below.

TABLE 6

| Trade name of | AC voltage | | |
|---|---|---|---|
| recording sheet | Vpp (kV) | Frequency f (Hz) | Voff (kV) |
| A | 8.6 | 500 | 2.0 |
| B | 8.8 | 500 | 2.0 |
| C | 8.7 | 500 | 2.0 |
| D | 9.2 | 600 | 2.1 |
| ... | ... | ... | ... |
| ... | ... | ... | ... |

In the data table, each of the recording sheet types is associated with the trade name and the appropriate peak-to-peak voltage Vpp, frequency f, and offset voltage Voff corresponding to the recording sheet type. In TABLE 6, a simple alphabetical character is used, for convenience, in each of the fields of the trade name. In the actual data table, however, the trade names of the recording sheets placed on the market by manufacturers are input in the fields. In the data table, the peak-to-peak voltage Vpp and the offset voltage Voff corresponding to each of the recording sheet types are set as follows. That is, the appropriate Vr lower limit value is obtained with the use of the corresponding recording sheet in a similar manner as in the sixth print test. Thereafter, the peak-to-peak voltage Vpp and the offset voltage Voff are set to the respective values for attaining the appropriate Vr lower limit value. Therefore, in the case of a recording sheet of the trade name A, for example, a secondary transfer bias having the combination of the peak-to-peak voltage Vpp and the offset voltage Voff corresponding to the trade name A in the data table is applied to the recording sheet. Thereby, the formation of the uneven density pattern is minimized.

If the user has changed the sheet type of the recording sheet P stored in the paper tray 100, the user presses a sheet type change button provided in the control panel 50. Upon detection of the button press operation, the controller 60 causes the control panel 50 to display, on the touch panel screen, a list of all of the trade names included in the data table of TABLE 6 to inquire of the user which one of the trade names corresponds to the set recording sheet. If the user selects, on the screen, the trade name of the set recording sheet in response to the inquiry, the controller 60 updates data of the set recording sheet trade name stored in the flash memory into data of the selected trade name. Further, the controller 60 identifies, from the data table of TABLE 6, the combination of the peak-to-peak voltage Vpp, the frequency f, and the offset voltage Voff corresponding to the trade name. Then, the controller 60 updates the target peak-to-peak voltage Vpp, the target frequency f, and the target offset voltage Voff stored in the flash memory into the values of the identification results. When a print job starts, the controller 60 outputs a control signal to the secondary transfer bias power supply 39 such that the peak-to-peak voltage Vpp having the target peak-to-peak voltage Vpp value, the frequency f having the target frequency f value, and the offset voltage Voff having the target offset voltage Voff value are output from the secondary transfer bias power supply 39. Thereby, the secondary transfer bias including the superimposed bias satisfying the appropriate Vr lower limit value is applied to the secondary transfer inner surface roller 33.

In the printer 301, the Voff-Vpp combination is thus changed in accordance with the sheet type. As understood from FIG. 2 described above, if the Voff-Vpp combination is changed, the returning peak value Vr is also changed accordingly. That is, the printer 301 is configured to change the returning peak value Vr in accordance with the sheet type.

Further, in the printer 301, not all the recording sheet types included in the data table of TABLE 6 are necessarily sheets with substantial surface roughness, such as Japanese paper. The recording sheet types also include plain paper. The uneven density pattern is not formed in a recording sheet with little surface roughness. In some cases, therefore, it is preferable to apply, as the secondary transfer bias, the DC bias instead of the superimposed bias. In view of this, the data table includes blank fields of the peak-to-peak voltage Vpp and the frequency f for the recording sheet with little surface roughness. If the fields of the peak-to-peak voltage Vpp and the frequency f for a given recording sheet are blank, the controller 60 outputs a control signal to the secondary transfer bias power supply 39 to output only the offset voltage Voff to the recording sheet.

Meanwhile, if the fields of the peak-to-peak voltage Vpp and the frequency f for a given recording sheet are not blank, i.e., in the case of a recording sheet with surface roughness, the appropriate Vr lower limit value is attained by the corresponding combination of the peak-to-peak voltage Vpp and the offset voltage Voff included in the data table. Therefore, the combination satisfies the following condition. That is, according to the condition, a relation of $\frac{1}{4}*Vpp>|Vd|$ holds between the peak-to-peak voltage Vpp (V) of the AC component and a value Vd representing the time-averaged value of the potential difference between the core of the secondary transfer inner surface roller 33 and the core of the nip formation roller 36, and the potential of the core of the nip formation roller 36 is increased toward the opposite polarity to the charge polarity of the toner to be higher than the potential of the core of the secondary transfer inner surface roller 33.

Further, each of the frequencies fin the data table is set to the value satisfying the condition of $f>(4/d)*v$ where f represents the frequency f in hertz, d represents the nip length, and v represents the process linear velocity. As described in the first print test, therefore, a favorable image free from pitch irregularity is obtained. If the printer 301 performs switching between a plurality of speed modes different from one another in the process linear velocity v, such as switching between a high-speed mode and a normal mode, data tables specific to the respective speed modes are stored in the flash memory. Thereby, the condition of f>(4/d)*v is satisfied in all of the speed modes.

The white spots attributed to discharge appear in a state in which the peak-to-peak voltage Vpp is relatively high and the absolute value |Voff| of the offset voltage Voff is relatively large. This state corresponds to the state in which a transferring peak value Vt (see FIG. 2) of polarity for moving the toner from the intermediate transfer belt 31 toward the recording sheet P is relatively large. It is considered that the transferring peak value Vt represented by an equation of |Vt|=|Voff|+|Vr| is related to the appearance of white spots attributed to discharge. It is observed from FIG. 2 that, if the transferring peak value Vt and the offset voltage Voff both have negative polarity, a relation of Vt=−½*Vpp+Voff holds. Therefore, a relation of Voff=½*Vpp+Vt is established. Meanwhile, the straight line L3 illustrated in FIG. 9 is represented by an equation of Voff=½*Vpp−4.55. It is therefore understood that noticeable white spots appear in a region corresponding to a transferring peak value Vt of approximately −4.55 kV or larger.

The present inventors investigated the voltage causing an abnormal image attributed to discharge, under a plurality of conditions different from one another in a lower limit value Voffmin of the offset voltage Voff in a region in which favorable images are formed. As a result, it was found that the appearance of white spots attributed to discharge is, as expected, related to the transferring peak value Vt, and that a relation between the lower limit value Voffmin and an upper limit value Vtmax of the transferring peak value Vt capable of minimizing the appearance of white spots to the acceptable level is represented by a correlation of Vtmax=1.7*Voffmin−3.1. With the case of using toner of positive polarity also taken into account, it is desirable that the secondary transfer bias satisfies a correlation of |Vtmax|=1.7*|Voffmin|+3.1 modified from the above correlation.

In view of the above, the secondary transfer bias power supply 39 of the printer 301 according to the first embodiment is configured to apply the secondary transfer bias satisfying the correlation of |Vtmax|=1.7*|Voffmin|+3.1.

In the printer 301, the combination of the secondary transfer bias power supply 39, the controller 60, and so forth constitutes a potential difference generator.

Subsequently, description is given of modified examples of the printer 301 according to the first embodiment.

Printers according to the modified examples are similar in configuration to the printer 301 according to the first embodiment, unless otherwise specified.

A first modified example will now be described.

Figure 25:
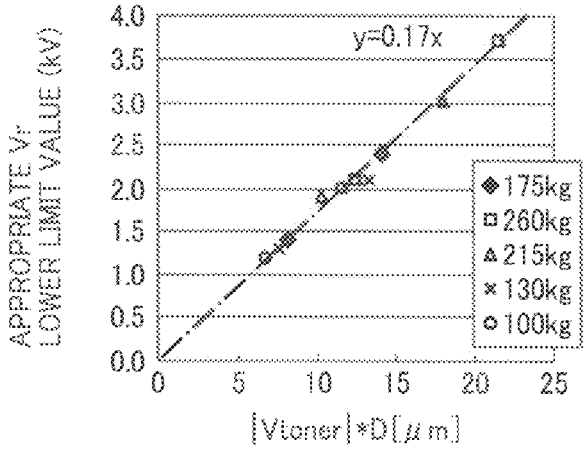
FIG. 25 is a graph illustrating a relation between the appropriate lower limit value of the returning peak value, a toner image potential, and the maximum recess depth in the sixth print test.

As illustrated in FIG. 25 described above, the appropriate Vr lower limit value is represented by the equation of Vrl=0.17*|Vtoner|*D (hereinafter referred to as the first formula). Meanwhile, as illustrated in FIG. 2 described above, the returning peak value Vr corresponds to the value obtained by subtraction of the absolute value of the offset voltage Voff from the amplitude half the peak-to-peak voltage Vpp. Therefore, an equation of ½*Vpp−|Voff|=Vr holds (hereinafter referred to as the second formula). If the value of the left side of the second formula is larger than the value of the right side of the first formula, the returning peak value Vr is larger than the appropriate Vr lower limit value. That is, a sufficient amount of toner is transferred into the recesses, and the formation of the uneven density pattern is minimized. Therefore, an equation of ½*Vpp−|Voff|>0.17*|Vtoner|*D (hereinafter referred to as the third formula) should be satisfied.

The controller 60 stores in the flash memory a data table as illustrated in TABLE 7 given below.

TABLE 7

| Trade name of recording sheet | Maximum recess depth D (μm) |
|---|---|
| A | 125 |
| B | 130 |
| C | 210 |
| D | 180 |
| ... | ... |
| ... | ... |
| ... | ... |

In the data table, each of the recording sheet types is associated with the trade name and the maximum recess depth D (μm) corresponding to the recording sheet type. The maximum recess depth D is obtained by the above-described recess depth measurement test.

As illustrated in FIG. 3 described above, the printer 301 includes the potential sensor 38. The potential sensor 38 is capable of measuring the toner image potential Vtoner of the toner images of the respective colors primarily transferred onto the intermediate transfer belt 31. The controller 60 forms a solid image of a predetermined size on the intermediate transfer belt 31 with a predetermined toner adhesion amount at a predetermined time, such as immediately before the start of a print job based on a command from the user and an inter-sheet interval during a continuous print job. The potential sensor 38 measures the toner image potential Vtoner of the thus formed image. Then, the controller 60 stores the measurement result in the flash memory.

If the user has changed the sheet type of the recording sheet P stored in the paper tray 100, the user presses a sheet type change button provided in the control panel 50. Upon detection of the button press operation, the controller 60 causes the control panel 50 to display, on the touch panel screen, a list of all of the trade names included in the data table of TABLE 7 to inquire of the user which one of the trade names corresponds to the set recording sheet. If the user selects, on the screen, the trade name of the set recording sheet in response to the inquiry, the controller 60 updates data of the set recording sheet trade name stored in the flash memory into data of the selected trade name. Further, the controller 60 identifies, from the data table of TABLE 7, data of the maximum recess depth D corresponding to the trade name. Then, on the basis of data of the maximum recess depth D and data of the toner image potential Vtoner stored in the flash memory, the controller 60 calculates the appropriate Vr lower limit value from the first formula described above, and stores the calculation result in the flash memory.

The controller 60 also stores in the flash memory a data table as illustrated in TABLE 8 given below.

TABLE 8

| Appropriate Vr | AC voltage | | |
|---|---|---|---|
| lower limit value | Vpp (kV) | Frequency f (Hz) | Voff (kV) |
| 100 to 149 | 8.0 | 500 | 2.5 |
| 150 to 199 | 8.0 | 500 | 2.0 |
| 200 to 249 | 8.5 | 500 | 1.8 |
| 250 to 299 | 9.0 | 600 | 1.5 |
| ... | ... | ... | ... |
| ... | ... | ... | ... |
| ... | ... | ... | ... |

Upon acquisition of the above-described calculation result of the appropriate Vr lower limit value, the controller 60 identifies, from the data table, the combination of the peak-to-peak voltage Vpp, the frequency f, and the offset voltage Voff corresponding to the calculation result. Then, the controller 60 updates the target peak-to-peak voltage Vpp value, the target frequency f value, and the target offset voltage Voff value stored in the flash memory into the values of the identification results. When a print job process is started, the controller 60 outputs a control signal to the secondary transfer bias power supply 39 such that the peak-to-peak voltage Vpp having the target peak-to-peak voltage Vpp value, the frequency f having the target frequency f value, and the offset voltage Voff having the target offset voltage Voff value are output from the secondary transfer bias power supply 39. Thereby, the secondary transfer bias including the superimposed bias satisfying the appropriate Vr lower limit value is applied to the secondary transfer inner surface roller 33.

In the printer 301, not all the recording sheet types included in the data table of TABLE 7 are necessarily sheets with substantial surface roughness, such as Japanese paper. The recording sheet types also include plain paper. The uneven density pattern is not formed in a recording sheet with little surface roughness. In some cases, therefore, it is preferable to apply, as the secondary transfer bias, the DC bias instead of the superimposed bias. In view of this, the data table includes a blank field of the maximum recess depth D for the recording sheet with little surface roughness. If the field of the maximum recess depth D for a given recording sheet is blank, the controller 60 outputs a control signal to the secondary transfer bias power supply 39 to output only the offset voltage Voff to the recording sheet.

Further, in the printer 301, if a recording sheet has surface roughness but has a relatively small value of the maximum recess depth D, as in the paper SAZANAMI, the field of the maximum recess depth D in the data table of TABLE 7 is input not with a numerical value but with an alphabetical character "S," which indicates a relatively small depth value. If the field of the maximum recess depth D for a given recording sheet is input with the alphabetical character "S," the controller 60 does not identify the peak-to-peak voltage Vpp and the offset voltage Voff by calculating the appropriate Vr lower limit value on the basis of the maximum recess depth D, but employs a predetermined Voff-Vpp combination, which has been preset. The combination is set to satisfy the condition of $\frac{1}{4}*Vpp>|Voff|$.

The use of such a fixed combination for a recording sheet having a relatively small value of the maximum recess depth D, such as the paper SAZANAMI, is based on the following reason. That is, the present inventors found from experiments that, in the case of a recording sheet having a relatively small value of the maximum recess depth D, the Voff-Vpp combination calculated on the basis of the maximum recess depth D does not satisfy the condition of $\frac{1}{4}*Vpp>|Voff|$ and thus fails to sufficiently minimize the formation of the uneven density pattern. With the use of the above-described fixed combination for the recording sheet having a relatively small value of the maximum recess depth D, such an undesirable situation is prevented.

Subsequently, a second modified example will be described.

Figure 26:
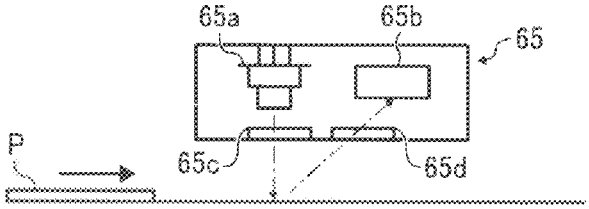
FIG. 26 is an enlarged configuration diagram illustrating a recess depth measurement device mounted in a printer according to a second modified example.

FIG. 26 is an enlarged configuration diagram illustrating a recess depth measurement device 65 installed in a printer according to the second modified example. The recess depth measurement device 65 includes a semiconductor laser device 65*a* serving as a light source, an optical position detection device 65*b*, a projection lens 65*c*, and a light receiving lens 65*d*. A coherent light beam emitted from the semiconductor laser device 65*a* is collected through the projection lens 65*c*, and is applied to a predetermined area on the recording sheet P. A part of the beam diffusely reflected from the recording sheet P passes through the light receiving lens 65*d*, and the beam spot is formed into an image on the optical position detection device 65*b*. The position of the beam spot is detected to detect the depth of the recesses in the surface of the recording sheet P. The thus configured recess depth measurement device 65 is disposed at a position immediately before the registration roller pair 101 depicted in FIG. 3 to detect the depth of the recesses in the surface of the recording sheet P.

Figure 27:
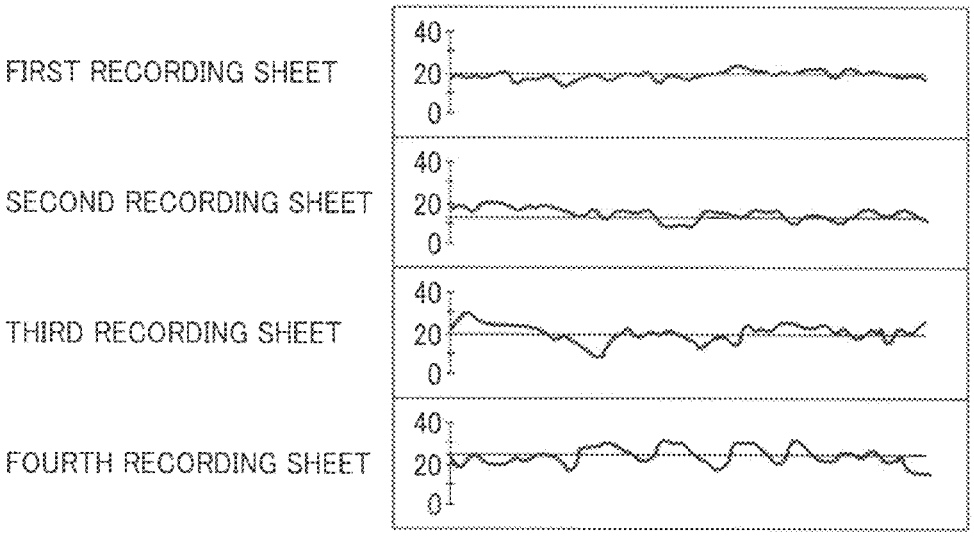
FIG. 27 is waveform charts illustrating voltages output from the recess depth measurement device shown in FIG. 26 measuring recess depths of recording sheets in a sheet feeding process.

FIG. 27 is waveform charts illustrating voltages output from the recess depth measurement device 65 measuring the depths of the recesses of recording sheets in a sheet feeding process. In the drawing, first and second recording sheets have relatively high surface smoothness. As illustrated in the drawing, there are relatively small fluctuations in the voltages output from the recess depth measurement device 65 detecting such recording sheets. Meanwhile, third and fourth recording sheets have relatively low surface smoothness. As illustrated in the drawing, there are relatively large fluctuations in the voltages output from the recess depth measurement device 65 detecting such recording sheets. The controller 60 analyzes such fluctuations in waveform to calculate the recess depth of the recording sheet P immediately before being conveyed to the registration roller pair 101.

The controller 60 having calculated the recess depth determines the calculation result as the maximum recess depth D. Then, the controller 60 identifies the peak-to-peak voltage Vpp, the frequency f, and the offset voltage Voff corresponding to the maximum recess depth D, and updates the target peak-to-peak voltage Vpp value, the target frequency f value, and the target offset voltage Voff value into the values of the identification results, similarly as in the first modified example.

Subsequently, a third modified example will be described.

Figure 28:
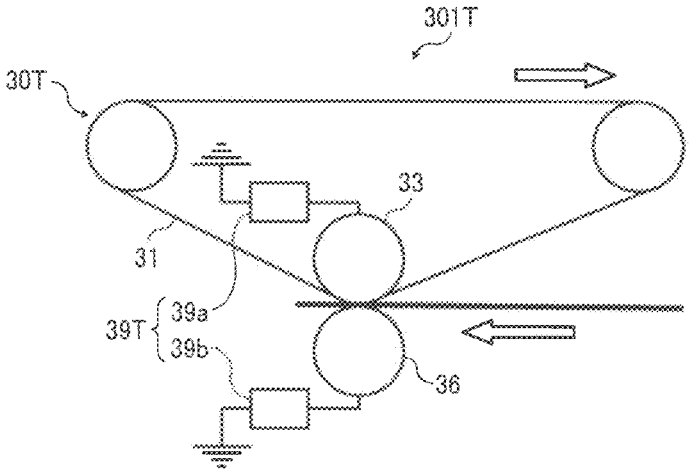
FIG. 28 is a schematic configuration diagram illustrating a transfer unit of a printer according to a third modified example.

FIG. 28 is a schematic configuration diagram illustrating a transfer unit 30T of a printer 301T according to the third modified example. A secondary transfer bias power supply 39T of the transfer unit 30T in this example includes a first power supply 39*a* and a second power supply 39*b*. The first power supply 39*a* outputs, as the secondary transfer bias, a superimposed bias including a DC voltage superimposed on an AC voltage, and applies the secondary transfer bias to the secondary transfer inner surface roller 33. Meanwhile, the second power supply 39*b* outputs, as the secondary transfer bias, a bias including only a DC voltage and having polarity opposite the polarity of the toner, and applies the secondary transfer bias to the nip formation roller 36.

The controller 60 determines the condition of the secondary transfer bias to be employed, similarly as in the first modified example. Then, if it is determined to employ the superimposed bias as the secondary transfer bias, the controller 60 transmits a control signal to the first power supply 39*a* such that the first power supply 39*a* outputs the secondary transfer bias including the superimposed bias. Meanwhile, if it is determined to employ the secondary transfer bias including only the DC bias, the controller 60 transmits a control signal to the second power supply 39*b* such that the second power supply 39*b* outputs the secondary transfer bias including the DC bias.

It is possible to perform, in a single power supply, switching between the secondary transfer bias including only the DC voltage and the secondary transfer bias including the superimposed bias. However, many of the printers currently on the market are configured to output only the secondary transfer bias including only the DC voltage. If such printers are converted to allow the application of the present invention thereto, the existing power supply needs to be removed. Meanwhile, according to the configuration in which the switching between two types of biases is performed by mutually different power supplies, as in the illustrated example, only the addition of a new power supply is necessary, and the existing power supply which outputs only the DC bias can continue to be used. Accordingly, it is possible to convert an existing model with relative ease.

The present example is also advantageous in allowing effective use of an empty space in an existing printer owing to the configuration in which the first and second power supplies 39*a* and 39*b* apply voltages to the mutually different rollers.

The above description has been made of an example of application of the present invention to the secondary transfer nip formed by the contact of the intermediate transfer belt 31 serving as an image carrier and the nip formation roller 36 serving as a first rotary body. The present invention is also applicable to a primary transfer nip as described below. That is, an inner surface contact member is brought into contact with an inner circumferential surface of an endless belt-shaped photoconductor serving as an image carrier to press the endless belt-shaped photoconductor against a nip forming member and bring the photoconductor and the nip forming member into contact with each other. Thereby, the primary transfer nip is formed.

Figure 29:
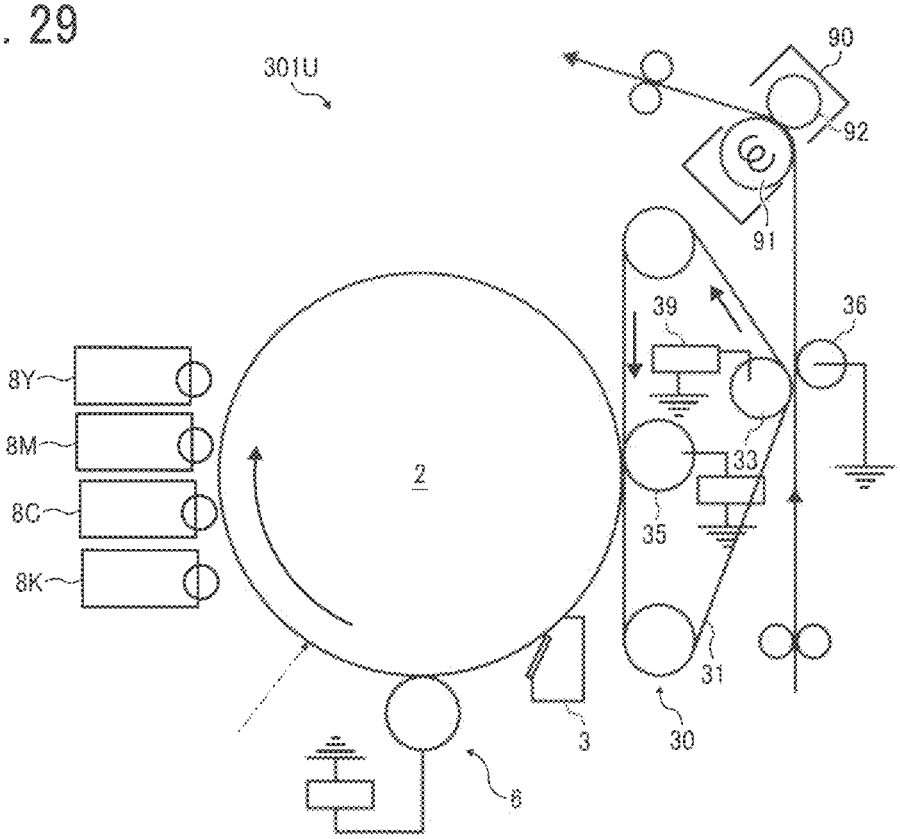
FIG. 29 is a schematic configuration diagram illustrating a printer according to a fourth modified example.

The present invention is also applicable to the secondary transfer nip of a printer 301U having a configuration as illustrated in FIG. 29. The printer 301U includes development devices 8Y, 8M, 8C, and 8K for the Y, M, C and K colors arranged around a circumference of a single photoconductor 2. In an image forming operation, an outer circumferential surface of the photoconductor 2 is first uniformly charged by a charger 6. Thereafter, laser light modified on the basis of image data for the Y color is applied to the outer circumferential surface of the photoconductor 2 to form an electrostatic latent image for the Y color on the outer circumferential surface of the photoconductor 2. Then, the electrostatic latent image for the Y color is developed into a Y toner image by the development device 8Y, and the Y toner image is primarily transferred onto the intermediate transfer belt 31. Thereafter, post-transfer residual toner remaining on the outer circumferential surface of the photoconductor 2 is removed by a photoconductor cleaner 3, and the outer circumferential surface of the photoconductor 2 is again uniformly charged by the charger 6. Then, laser light modified on the basis of image data for the M color is applied to the outer circumferential surface of the photoconductor 2 to form an electrostatic latent image for the M color on the outer circumferential surface of the photoconductor 2. Thereafter, the electrostatic latent image for the M color is developed into an M toner image by the development device 8M. Then, the M toner image is primarily transferred to be superimposed on the Y toner image on the intermediate transfer belt 31. Thereafter, a C toner image and a K toner image are sequentially developed on the outer circumferential surface of the photoconductor 2, and are sequentially primarily transferred to be superimposed on the Y and M toner images on the intermediate transfer belt 31. Thereby, a four-color superimposed toner image is formed on the intermediate transfer belt 31.

Thereafter, the toner images included in the four-color superimposed toner image on the intermediate transfer belt 31 are secondarily transferred onto a surface of a recording sheet at the same time in the secondary transfer nip. Thereby, a full-color image is formed on the recording sheet. Then, the full-color image is fixed on the recording sheet by the fixing device 90, and the recording sheet is discharged outside the printer 301T.

In the thus configured printer 301U, the secondary transfer bias power supply 39 may be configured similarly as in the first embodiment.

The above description has been made of an example of application of the present invention to the electrophotographic printers 301, 301T, and 301U. The present invention is also applicable to an image forming apparatus which forms a color image in accordance with a direct recording method. The direct recording method forms a pixel image not by using a latent image carrier but by using a toner jetting device which jets toners in dots such that the toners directly adhere to a recording sheet or an intermediate recording body. Thereby, a toner image is directly formed on the recording sheet or the intermediate recording body. The method has been used in background image forming apparatuses. The present invention is applicable to a transfer nip for transferring the toner image onto the recording sheet from the intermediate recording body serving as an image carrier.

Subsequently, description is given of a printer 301V according to a second embodiment.

Figure 30:
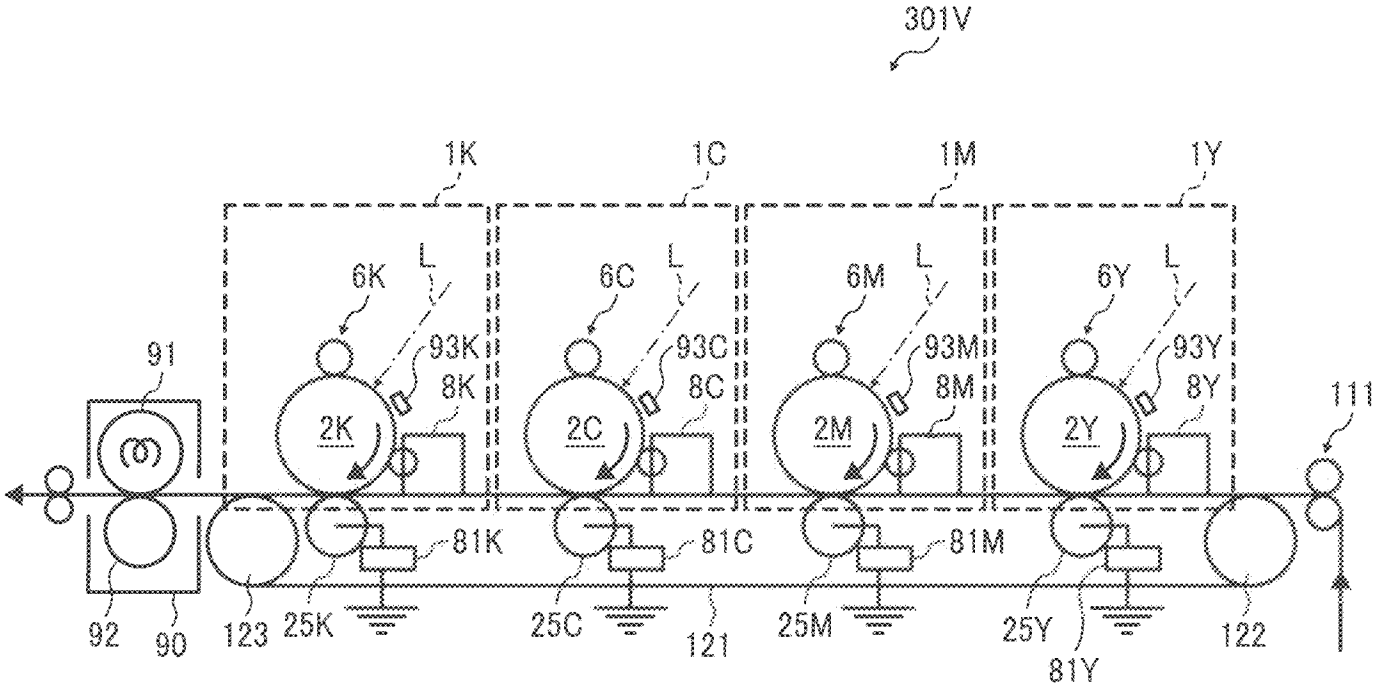
FIG. 30 is a schematic configuration diagram illustrating a printer according to a second embodiment.

The printer 301V according to the second embodiment is similar in configuration to the printers 301, 301T, and 301U according to the first embodiment and the modified examples, unless otherwise specified. FIG. 30 is a schematic configuration diagram illustrating the printer 301V according to the second embodiment. The printer 301V is different from the printer 301 according to the first embodiment in that an endless sheet conveying belt 121 replaces the intermediate transfer belt 31, and is brought into contact with the photoconductors 2Y, 2M, 2C, and 2K for the respective colors. The sheet conveying belt 121 carries a recording sheet on a surface thereof, and sequentially passes the recording sheet through transfer nips for the Y, M, C, and K colors in accordance with the rotational movement of the sheet conveying belt 121. In this process, Y, M, C, and K toner images on the photoconductors 2Y, 2M, 2C, and 2K are transferred onto a surface of the recording sheet in a superimposed manner.

The image forming units 1Y, 1M, 1C, and 1K include potential sensors 93Y, 93M, 93C, and 93K, respectively, each of which detects the potential of the electrostatic latent image formed on the surface of the corresponding one of the photoconductors 2Y, 2M, 2C, and 2K with laser light L applied thereto. Each of the potential sensors 93Y, 93M, 93C, and 93K is formed by a surface potential sensor EFS-22D manufactured by TDK Corporation, and is arranged to face the surface of the corresponding one of the photoconductors 2Y, 2M, 2C, and 2K via a gap of approximately 4 mm.

Inside the loop of the sheet conveying belt 121, the primary transfer rollers 25Y, 25M, 25C, and 25K for the Y, M, C, and K colors, serving as a second rotary body, come into contact with an inner circumferential surface of the sheet conveying belt 121 to press the sheet conveying belt 121 serving as an image carrier against the photoconductors 2Y, 2M, 2C, and 2K serving as a first rotary body. The primary transfer bias power supplies 81Y, 81M, 81C, and 81K, serving as a transfer bias supply, supply a transfer bias to the primary transfer rollers 25Y, 25M, 25C, and 25K.

In the printer 301V according to the second embodiment, the chargers 6Y, 6M, 6C, and 6K for uniformly charging the respective surfaces of the photoconductors 2Y, 2M, 2C, and 2K, an optical writer for performing optical writing on the uniformly charged surfaces of the photoconductors 2Y, 2M, 2C, and 2K, and the primary transfer rollers 25Y, 25M, 25C, and 25K constitute potential difference generators for the respective colors of Y, M, C, and K. The potential difference generators generate, between the electrostatic latent images on the photoconductors 2Y, 2M, 2C, and 2K and respective cores of the primary transfer rollers 25Y, 25M, 25C, and 25K pressed against the photoconductors 2Y, 2M, 2C, and 2K, a potential difference including a DC component and an AC component.

The configuration of brining the sheet conveying belt 121 into contact with the photoconductors 2Y, 2M, 2C, and 2K may be replaced by a configuration of bringing the primary transfer rollers 25Y, 25M, 25C, and 25K into direct contact with the photoconductors 2Y, 2M, 2C, and 2K, respectively, to form the primary transfer nips for the Y, M, C, and K colors. In this case, the primary transfer rollers 25Y, 25M, 25C, and 25K function as a second rotary body.

The primary transfer bias power supplies 81Y, 81M, 81C, and 81K are configured to change, in accordance with the sheet type, the returning peak value Vr in the potential difference between the electrostatic latent images on the photoconductors 2Y, 2M, 2C, and 2K and the respective cores of the primary transfer rollers 25Y, 25M, 25C, and 25K.

The controller 60 is configured to perform the following latent image potential measurement process at a predetermined time, such as immediately after power-on, in a standby state, and in a temporary halt state of a continuous print job. That is, the controller 60 forms on the photoconductors 2Y, 2M, 2C, and 2K patch-shaped electrostatic latent images having a size of 1 cm by 1 cm, and the respective potentials of the patch-shaped electrostatic latent images are detected by the potential sensors 93Y, 93M, 93C, and 93K. Then, the controller 60 stores the detection results in a data storage, such as the RAM. On the basis of the sheet type and the potential of the corresponding one of the patch-shaped electrostatic latent images for the Y, M, C, and K colors transmitted from the controller 60, each of the primary transfer bias power supplies 81Y, 81M, 81C, and 81K calculates the appropriate returning peak value Vr, and outputs the primary transfer bias including a superimposed bias capable of obtaining the calculation result. Thereby, the offset voltage Voff and the peak-to-peak voltage Vpp of the AC component satisfy the relation of $\frac{1}{4}*Vpp>|Voff|$, and the time-averaged value of the potential of the cores of the primary transfer rollers 25Y, 25M, 25C, and 25K is increased toward the opposite polarity to the charge polarity of toner to be larger than the time-averaged value of the potential of the electrostatic latent images on the photoconductors 2Y, 2M, 2C, and 2K. Then, similarly as in the first embodiment, the transfer bias including the superimposed bias satisfying the appropriate Vr lower limit value according to the sheet type is applied to the primary transfer rollers 25Y, 25M, 25C, and 25K.

Further, the present invention is also applicable to an image forming apparatus which may be a copier, a facsimile machine, a printer, a multifunction printer having at least one of copying, printing, scanning, plotter, and facsimile functions, or the like, that forms a monochrome toner image, a color toner image, or both.

As described above, a recording sheet having relatively shallower recesses on the surface thereof requires a relatively decreased lower limit value of the returning peak value Vr that transfers a sufficient amount of toner to the recesses, generating discharge in the recesses easily. To address such characteristic of the recording sheet having the relatively shallower recesses, the returning peak value Vr is decreased relatively, maintaining the uneven density pattern within the acceptable range and minimizing the appearance of white spots.

Conversely, a recording sheet having relatively deeper recesses on the surface thereof requires a relatively increased lower limit value of the returning peak value Vr that transfers a sufficient amount of toner to the recesses, suppressing discharge in the recesses. To address such characteristic of the recording sheet having the relatively deeper recesses, the returning peak value Vr is increased relatively, maintaining the appearance of white spots within the acceptable range and minimizing formation of the uneven density pattern.

For example, the returning peak value Vr of the transfer bias including the superimposed bias is changed to the value appropriate to the characteristic of the recording sheet on the basis of the sheet type of the recording sheet obtained by the type acquisition device, thus minimizing formation of the uneven density pattern conforming to the surface roughness of the recording sheet and at the same time minimizing the appearance of white spots attributed to discharge.

The above-described embodiments are illustrative and do not limit the present invention. Thus, numerous additional modifications and variations are possible in light of the above teachings. For example, elements or features of different illustrative and embodiments herein may be combined with or substituted for each other within the scope of this disclosure and the appended claims. Further, features of components of the embodiments, such as number, position, and shape, are not limited to those of the disclosed embodiments and thus may be set as preferred. It is therefore to be understood that, within the scope of the appended claims, the disclosure of the present invention may be practiced otherwise than as specifically described herein.

What is claimed is:

1. A transfer device comprising:

an image carrier movable in a predetermined moving direction to carry a toner image;

a first rotary body to contact an outer surface of the image carrier;

a second rotary body pressed against an inner surface of the image carrier to form a transfer nip between the outer surface of the image carrier and the first rotary body;

a transfer bias supply operatively connected to one of the first and second rotary bodies to supply a transfer bias, including a superimposed bias that includes a direct current component and an alternating current component superimposed on the direct current component for application to the image carrier, to transfer the toner image from the image carrier onto a recording medium conveyed through the transfer nip, wherein the direct current component of the transfer bias is provided to cause the other of the first and second rotary bodies to have an electrical potential higher than that of the image carrier and with a polarity opposite to a charge polarity of toner of the toner image, and wherein the alternating current component of the transfer bias has a returning peak with a polarity opposite to the polarity of the direct current component; and a controller operatively connected to the transfer bias supply to control the transfer bias supply, wherein the controller is configured to identify a recording medium type and to change a maximum value of the returning peak on the basis of the identified recording medium type, wherein the transfer bias supply increases the returning peak value in accordance with an increase in surface roughness of the recording medium corresponding to the identified recording medium type.

2. The transfer device according to claim 1, wherein the transfer bias supply supplies the transfer bias having a relation of $$\frac{1}{4}*Vpp>|Voff|$$

where Vpp represents a peak-to-peak voltage in volts of the alternating current component and Voff represents a voltage in volts of the direct current component.

3. The transfer device according to claim 2, wherein the transfer bias supply supplies the transfer bias having a relation of $$f>(4/d)*v$$

where f represents a frequency in hertz of the alternating current component, d represents a nip length in millimeters of the transfer nip in the moving direction of the image carrier, and v represents a moving speed in millimeters per second of the image carrier.

4. The transfer device according to claim 1, wherein the controller is operatively connected to a type acquisition device to acquire a type of the recording medium corresponding to surface roughness of the recording medium.

5. The transfer device according to claim 4, wherein the type acquisition device includes a control panel operatively connected to the transfer device to receive input from a user and identify the type of recording medium from the input.

6. The transfer device according to claim 4, wherein the type acquisition device includes a recess depth measurement device disposed upstream from the transfer device in a recording medium conveyance direction to detect a depth of recesses in a surface of the recording medium so as to identify the type of the recording medium.

7. The transfer device according to claim 6, further comprising a potential detector disposed opposite the image carrier to detect an electric potential of the toner image on the image carrier, wherein the transfer bias supply supplies the transfer bias having a relation of $$\frac{1}{2}*Vpp-(0.17*D1)*|Vtoner|>|Voff|$$

where Vpp represents a peak-to-peak voltage in volts of the alternating current component, D1 represents the depth of recesses in micrometers measured by the recess depth measurement device, Vtoner represents the potential of the toner image in volts detected by the potential detector, and Voff represents a voltage in volts of the direct current component.

8. The transfer device according to claim 1, wherein the controller includes an adhesion amount acquisition device to acquire an amount of toner of the toner image adhered to the image carrier per unit area, and wherein the transfer bias supply changes a voltage of the direct current component on the basis of the amount of toner acquired by the adhesion amount acquisition device.

9. The transfer device according to claim 1, wherein the transfer bias supply switches between a first mode for generating the transfer bias including the direct current component and the alternating current component and a second mode for generating the transfer bias including only the direct current component in accordance with the identified recording medium type.

10. The transfer device according to claim 9, wherein the transfer bias supply includes:

a first power supply to generate the transfer bias including the superimposed bias; and a second power supply to generate the transfer bias including only the direct current component.

11. An image forming apparatus comprising the transfer device according to claim 1.

12. A transfer device comprising:

an image carrier movable in a predetermined moving direction to carry a toner image; a first rotary body to contact an outer surface of the image carrier;

a second rotary body pressed against an inner surface of the image carrier to form a transfer nip between the outer surface of the image carrier and the first rotary body;

a transfer bias supply operatively connected to the first rotary body and the second rotary body to supply a transfer bias for application to the image carrier to transfer the toner image from the image carrier onto a recording medium conveyed through the transfer nip, the transfer bias supply including:

a first power supply to generate the transfer bias including a superimposed bias that includes a direct current component and an alternating current component superimposed on the direct current component for supply to one of the first rotary body and the second rotary body, wherein the direct current component of the transfer bias is provided to cause the other of the first and second rotary bodies to have an electrical potential higher than that of the image carrier and with a polarity opposite to a charge polarity of toner of the toner image, and wherein the alternating current component of the transfer bias has a returning peak with a polarity opposite to the polarity of the direct current component; and a second power supply to generate the transfer bias including only the direct current component for supply to the other one of the first rotary body and the second rotary body; and a controller operatively connected to the transfer bias supply to control the transfer bias supply, wherein the controller is configured to identify a recording medium type and to change a maximum value of the returning peak on the basis of the identified recording medium type, wherein the transfer bias supply increases the returning peak value in accordance with an increase in surface roughness of the recording medium corresponding to the identified recording medium type.

13. A transfer device comprising:

an intermediate transferor to contact a latent image carrier carrying a latent image to be developed into a toner image to form a primary transfer nip therebetween and carry the toner image transferred from the latent image carrier;

a first rotary body to contact an outer surface of the intermediate transferor;

a second rotary body pressed against an inner surface of the intermediate transferor to form a secondary transfer nip between the outer surface of the intermediate transferor and the first rotary body;

a transfer bias supply operatively connected to one of the first rotary body and the second rotary body to supply a transfer bias including a superimposed bias that includes a direct current component and an alternating current component superimposed on the direct current component for application to the intermediate transferor to transfer the toner image from the intermediate transferor onto a recording medium conveyed through the secondary transfer nip, wherein the direct current component of the transfer bias is provided to cause the other of the first and second rotary bodies to have an electrical potential higher than that of the image carrier and with a polarity opposite to a charge polarity of toner of the toner image, and wherein the alternating current component of the transfer bias has a returning peak with a polarity opposite to the polarity of the direct current component; and a controller operatively connected to the transfer bias supply to control the transfer bias supply, wherein the controller is configured to identify a recording medium type and to change a maximum value of the returning peak on the basis of the identified recording medium type, wherein the transfer bias supply increases the returning peak value in accordance with an increase in surface roughness of the recording medium corresponding to the identified recording medium type.

14. An image forming apparatus comprising:

an image carrier to carry a toner image;

a transfer member to contact the image carrier at a transfer nip;

a power supply to output a superimposed voltage to transfer the toner image from the image carrier onto a recording sheet in the transfer nip, the superimposed voltage being switched alternately between a transferring peak voltage (Vt) having a first polarity to move the toner image from the image carrier onto the recording sheet and a returning peak voltage (Vr) having a second polarity opposite to the first polarity while the recording sheet passes through the transfer nip; and a sheet type selector to select a sheet type of the recording sheet, wherein the power supply increases the returning peak voltage (Vr) with an increase in surface roughness of the recording sheet corresponding to the sheet type selected by the sheet type selector.

15. The image forming apparatus according to claim 14, wherein the sheet type selector includes a control panel to select the sheet type of the recording sheet manually.

16. The image forming apparatus according to claim 14, further comprising a photoconductor on which the toner image is formed, wherein the image carrier is an intermediate transfer belt onto which the toner image formed on the photoconductor is transferred.

17. The image forming apparatus according to claim 14, wherein the transfer member is a roller.

18. The image forming apparatus according to claim 14, wherein the transfer member is a belt.

19. The image forming apparatus according to claim 14, wherein a time-averaged value (Voff) of the superimposed voltage has a same polarity as the first polarity.

20. An image forming apparatus comprising:

an image carrier to carry a toner image;

a transfer member to contact the image carrier at a transfer nip;

a power supply to output a superimposed voltage to transfer the toner image from the image carrier onto paper in the transfer nip, the superimposed voltage being switched alternately between a transferring peak voltage (Vt) having a first polarity to move the toner image from the image carrier onto the paper and a returning peak voltage (Vr) having a second polarity opposite to the first polarity while the paper passes through the transfer nip; and a control panel to select a trade name of the paper, wherein the power supply increases the returning peak voltage (Vr) with an increase in a value of a maximum recess depth of the paper corresponding to the trade name selected by the control panel.

* * * * *